US005863192A

United States Patent [19]

Motegi

[11] Patent Number: 5,863,192

[45] Date of Patent: Jan. 26, 1999

[54] LOW NITROGEN OXIDES GENERATING METHOD AND APPARATUS

[75] Inventor: Toru Motegi, Tokyo, Japan

[73] Assignee: Tokyo Gas Company, Ltd., Tokyo, Japan

[21] Appl. No.: 633,042

[22] Filed: Apr. 16, 1996

[30] Foreign Application Priority Data

Apr. 19, 1995 [JP] Japan ..... 93598/1995
Nov. 8, 1995 [JP] Japan ..... 290211/1995

[51] Int. Cl.[6] ..... F23C 5/00

[52] U.S. Cl. ..... 431/8; 431/181; 431/354; 239/425; 239/426; 239/431; 239/434

[58] Field of Search ..... 431/8, 181, 177, 431/354; 239/425, 426, 431, 434

[56] References Cited

U.S. PATENT DOCUMENTS 5,486,108 1/1996 Kubota ..... 431/181
5,494,437 2/1996 Kubota et al. ..... 431/181

FOREIGN PATENT DOCUMENTS 60 155168 7/1985 Japan .
63 127979 5/1988 Japan .
2 65149 3/1990 Japan .
2 213817 8/1990 Japan .
50 148961 10/1997 Japan .

*Primary Examiner*—Carroll B. Dortiy
*Attorney, Agent, or Firm*—Townsend & Banta

[57] ABSTRACT

An object of the present invention is to achieve lower NOx combustion in response to the increasingly intensified NOx regulations for burners. The present invention provides a low nitrogen oxides generating combustion method and apparatus which utilizes effective self-induced exhaust gas recirculation before the initiation of the combustion of diffusion flames, or allows part of the combustion gas to be entrained by auxiliary fuel flow, air flow and fuel flow before the formation of the diffusion flames to further intensify the recirculation flow of the combustion gas by the diffusion flames or, in addition, which can achieve rich and lean combustion in the diffusion flames for decreasing the generation of NOx by a combination of these measures, and which are excellent in flame stability even in a low temperature atmosphere.

37 Claims, 38 Drawing Sheets

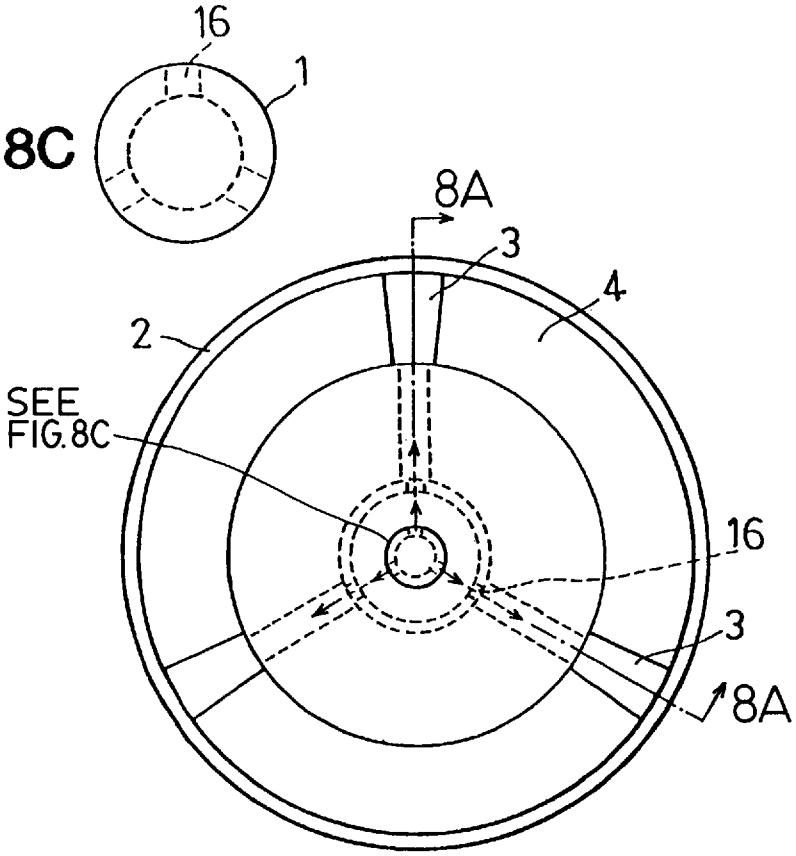
FIG.8C
FIG.8B
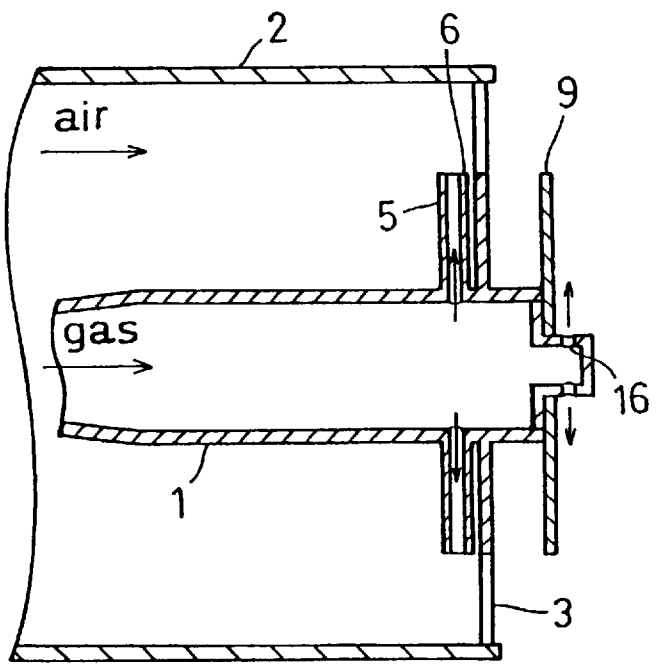
FIG.8A

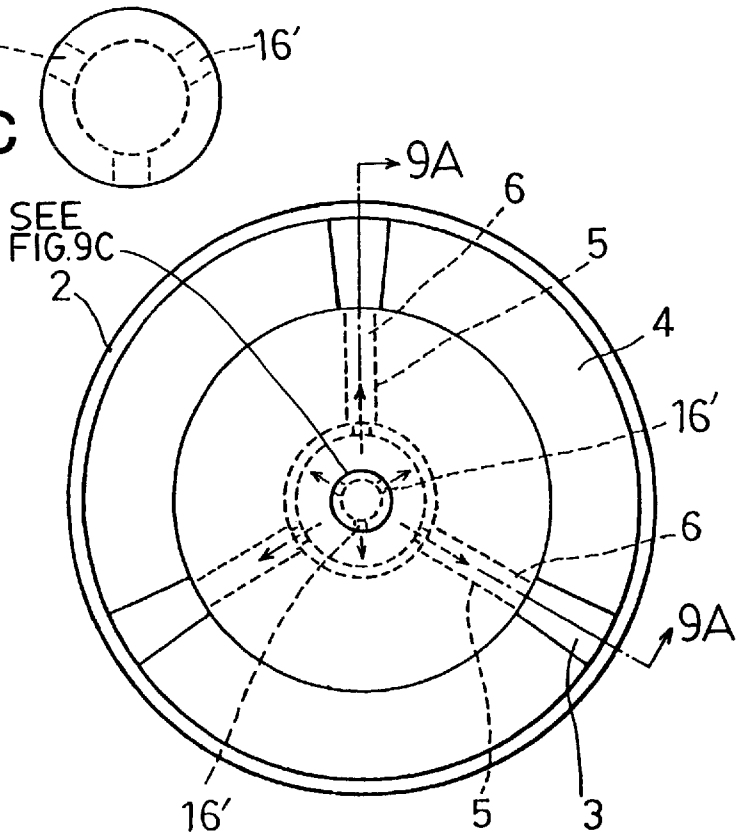
FIG.9C
FIG.9B
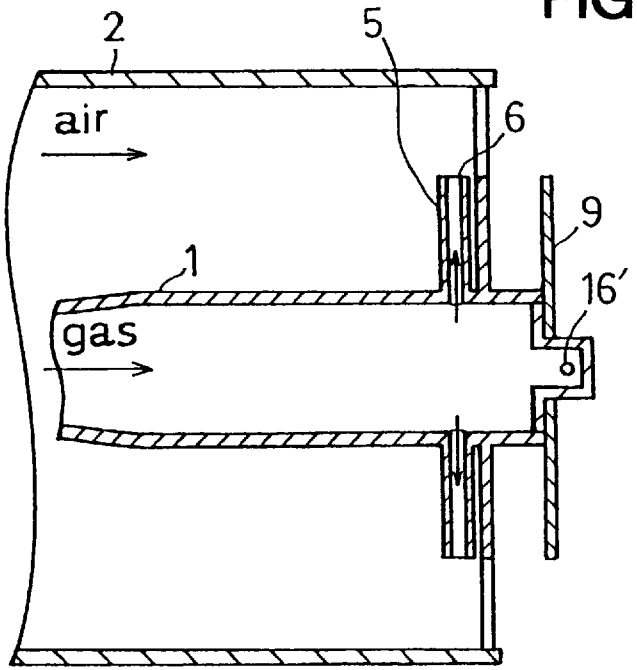
FIG.9A

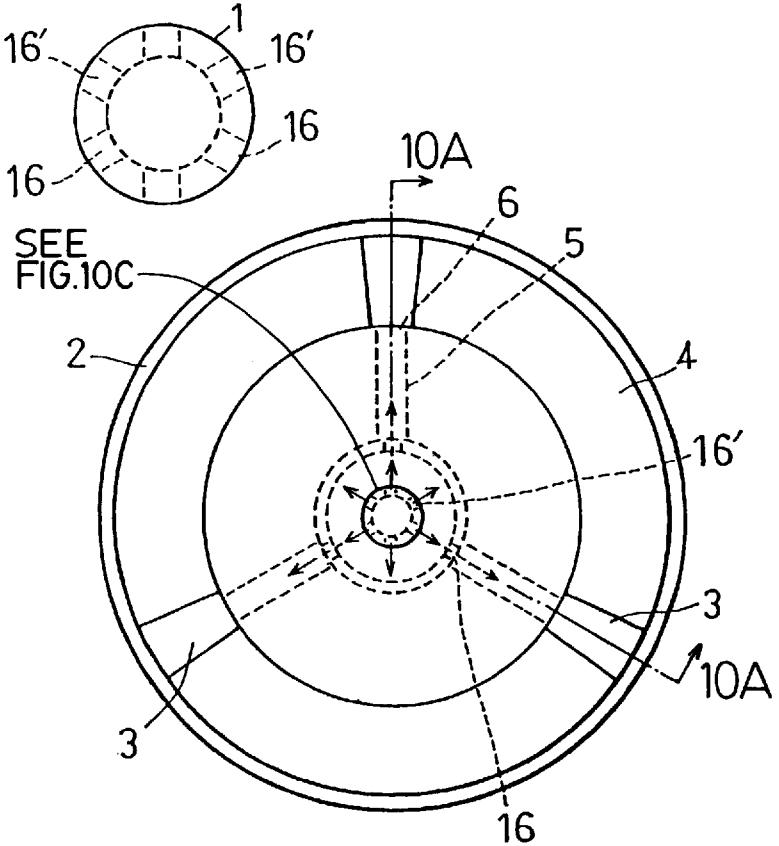
FIG.10C
FIG.10B
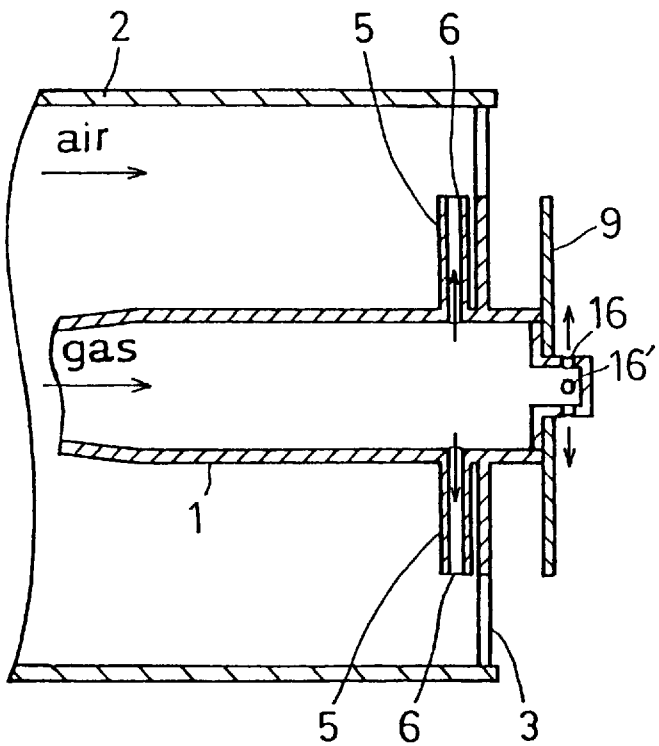
FIG.10A

SEE FIG.11C
SEE FIG.11D
air
gas
11A
16'
17
18
21
1
2
3
4
5
6
9

16
1
17
SEE FIG.12C
12A
3
6
5
4
17
6
3
12A
5
1

SEE FIG.12D
16
9
6
5
2
air
gas
1

1
17
21
18
16
9

12
11
15
13
10
14
9
16
19
3
6
5
2
air
gas
SEE FIG.13D
16 or 16'
1

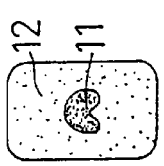
FIG. 14B
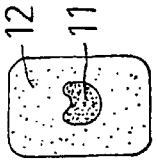
FIG. 14C
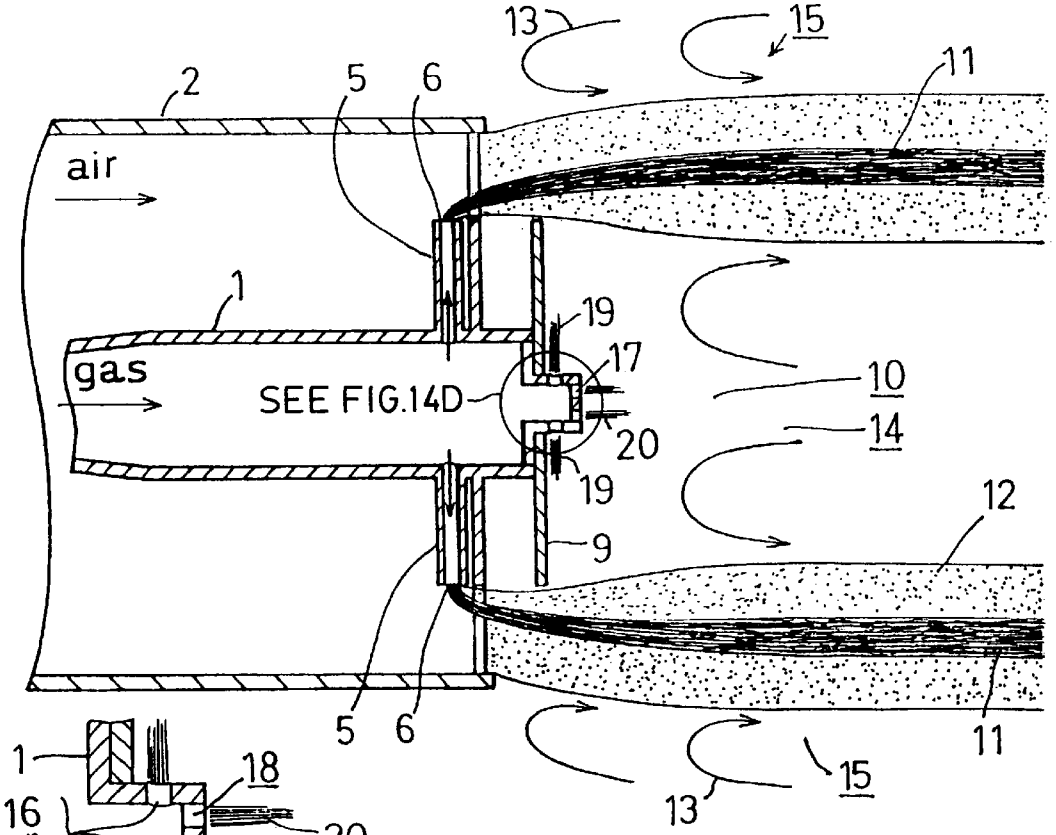
FIG. 14A
FIG. 14D

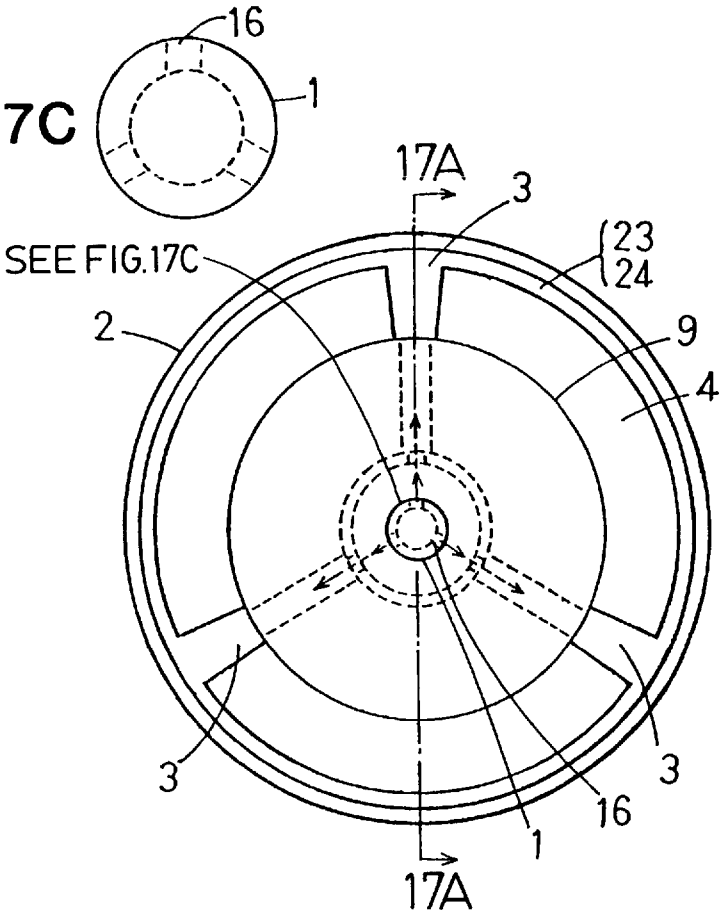
FIG.17B
FIG.17C
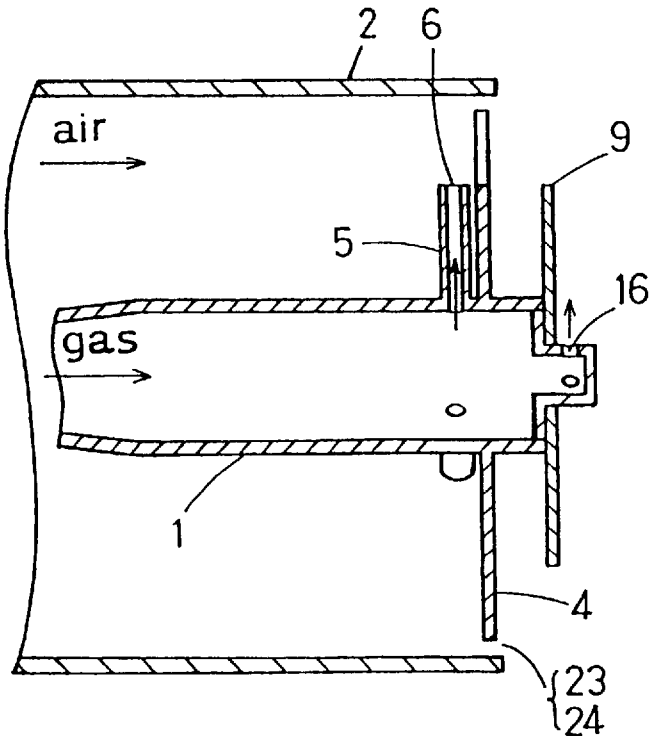
FIG.17A

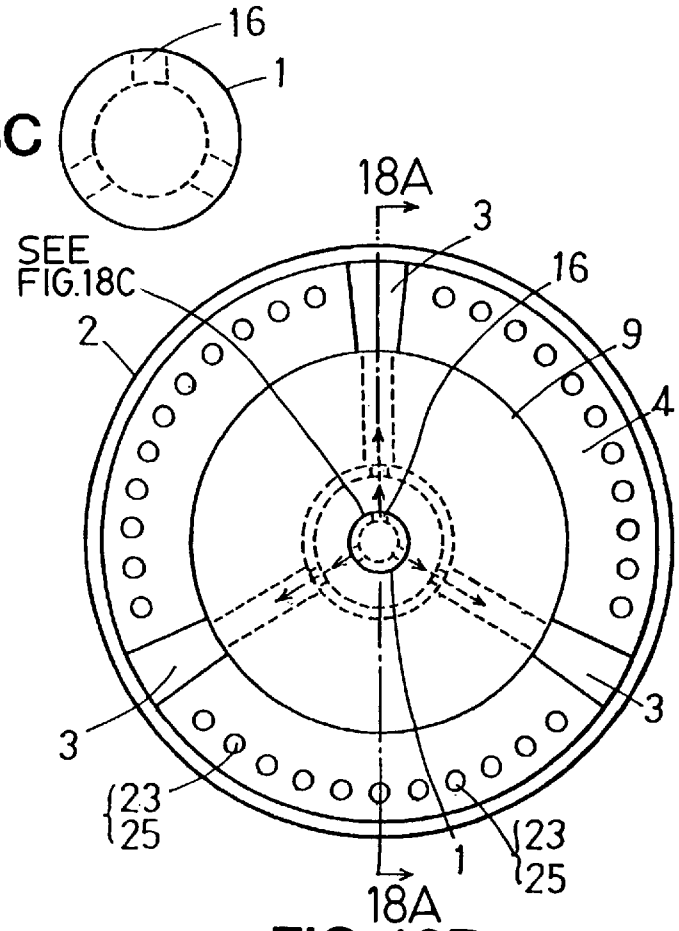
FIG.18C
FIG.18B
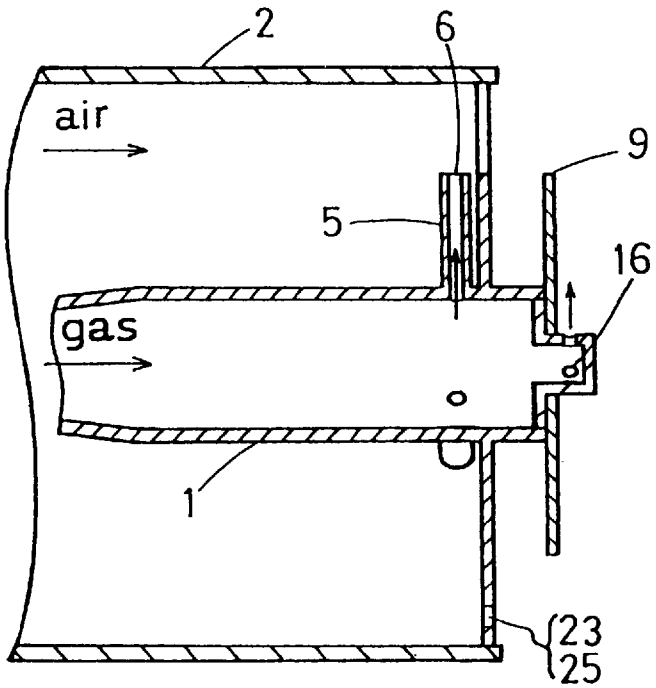
FIG.18A

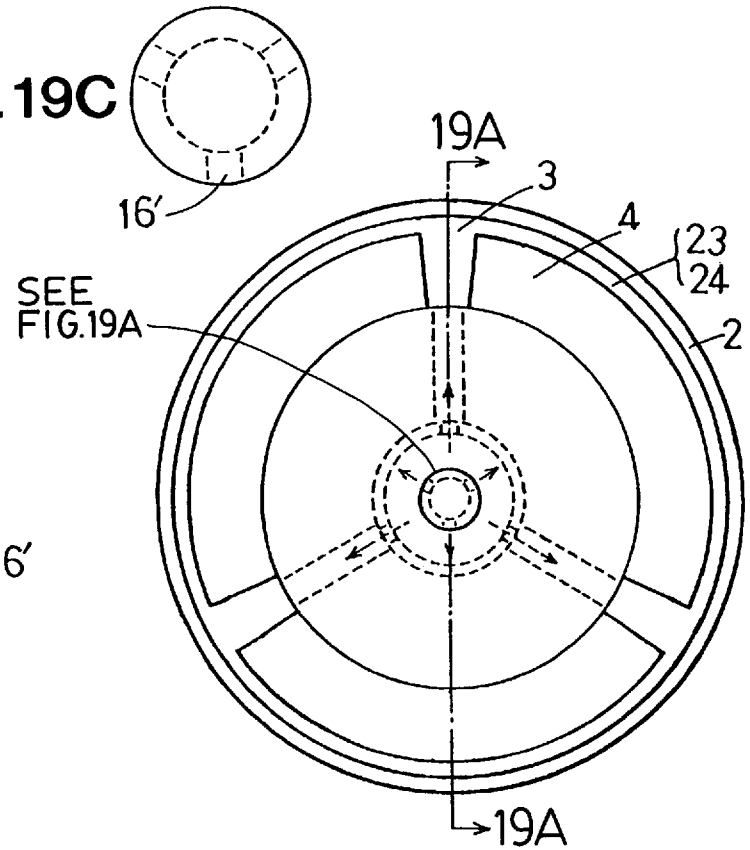
FIG.19C
FIG.19B
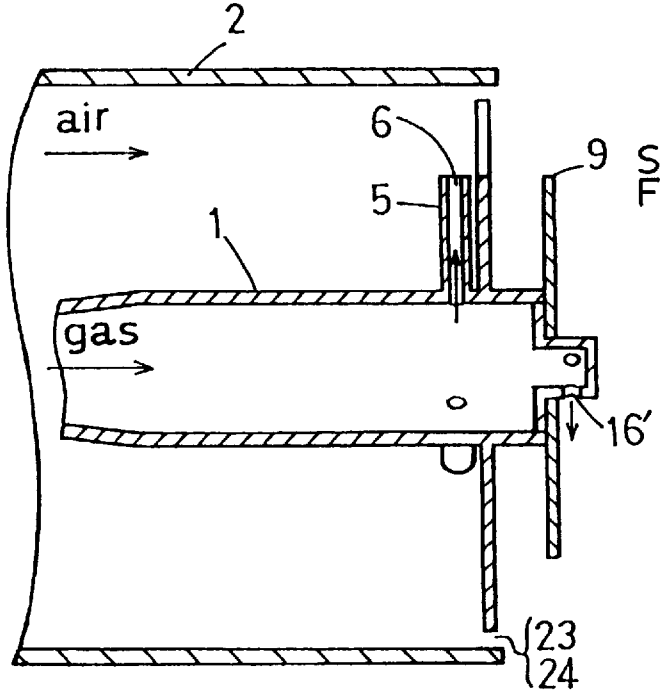
FIG.19A

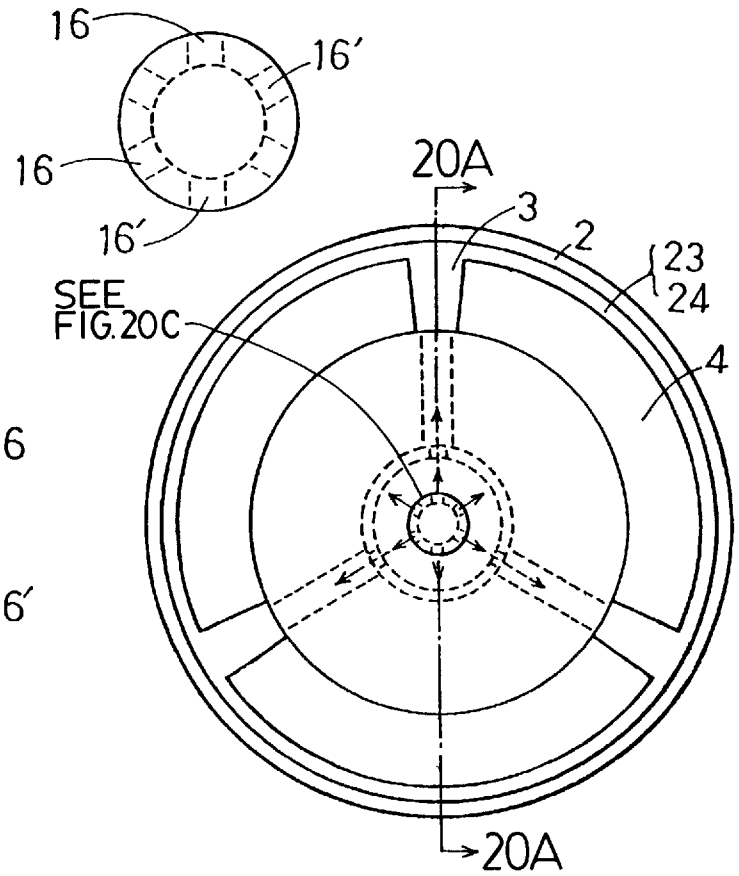
FIG.20C
FIG.20B
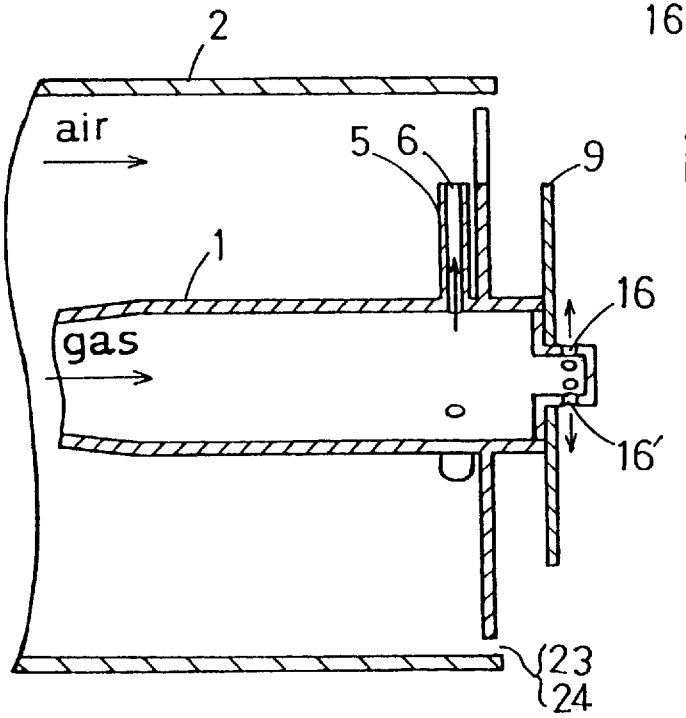
FIG.20A 17
16'
21A
3
2
23
24
4
SEE FIG.21C
SEE FIG.21D
9
6
5
1
air
gas
21
18

16
17

22A
3
2
23
24
4
22A

SEE FIG.22C
17
21
18

9
16
17
SEE FIG.22D
23
24
6
5
2
1
air
gas

SEE FIG.23C
air
gas
1
2
5
6
9
10
11
12
13
14
15
16
19
23
24
25
26

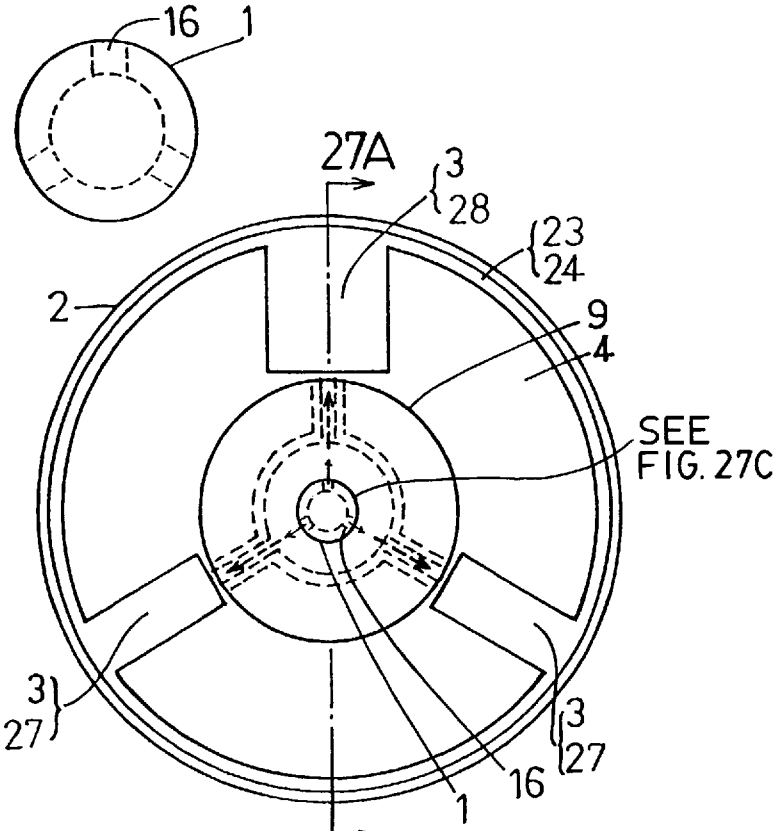
FIG.27B
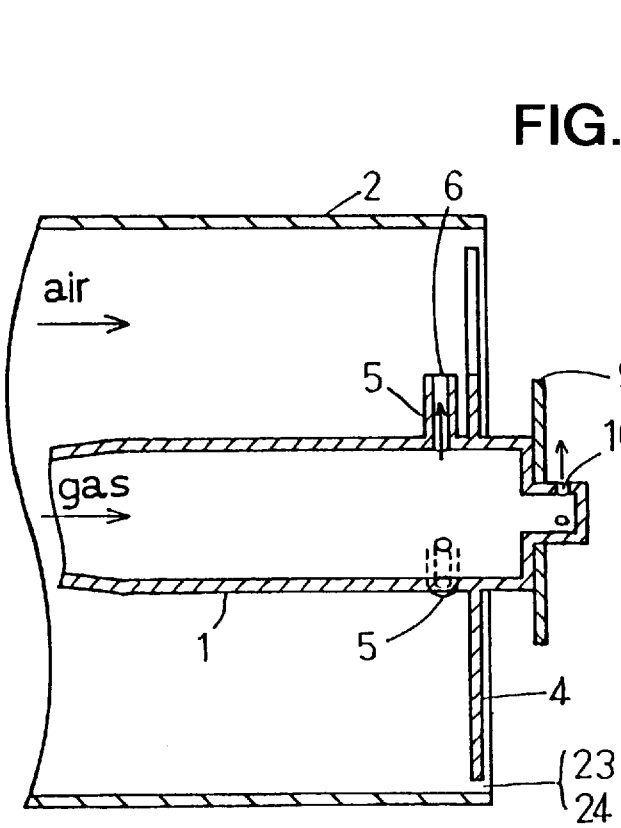
FIG.27C
FIG.27A

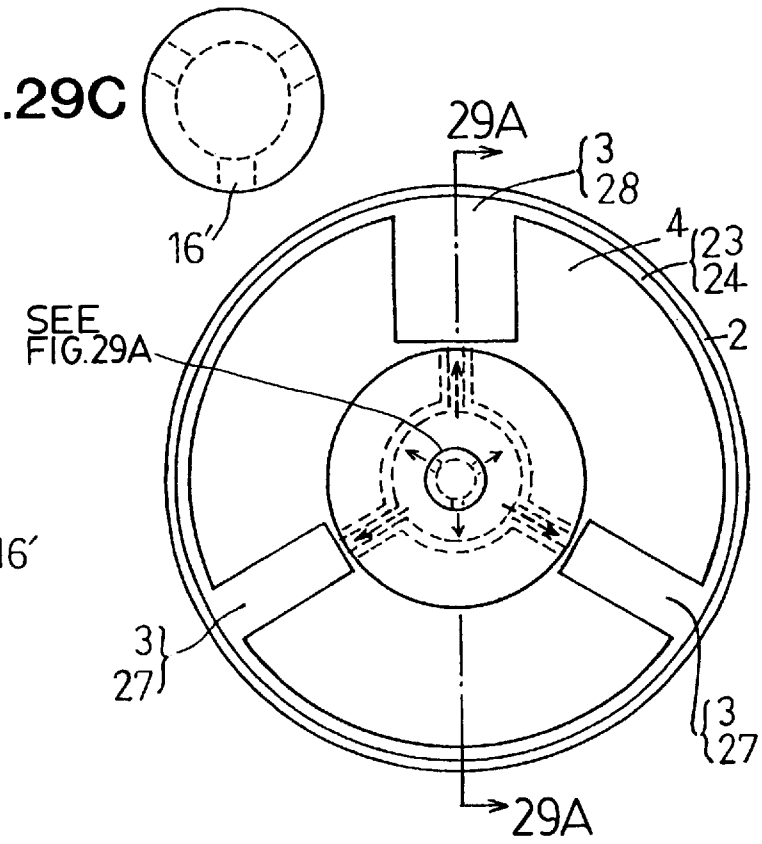
FIG.29C
FIG.29B
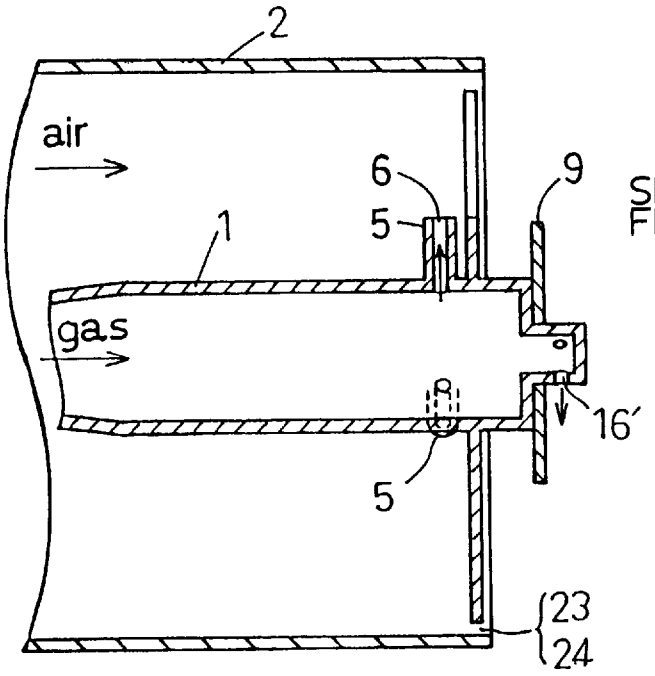
FIG.29A

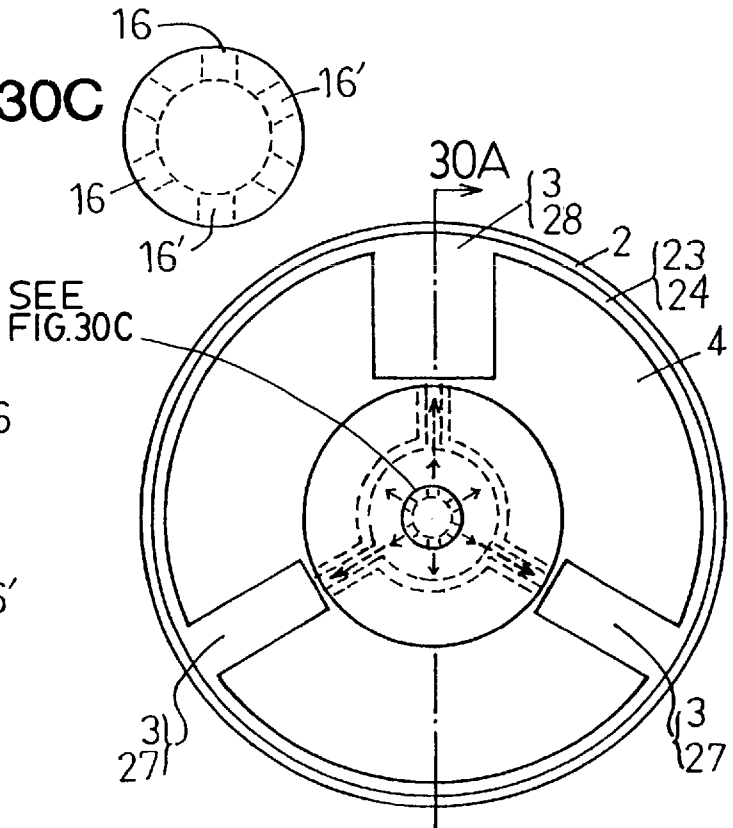
FIG.30C
FIG.30B
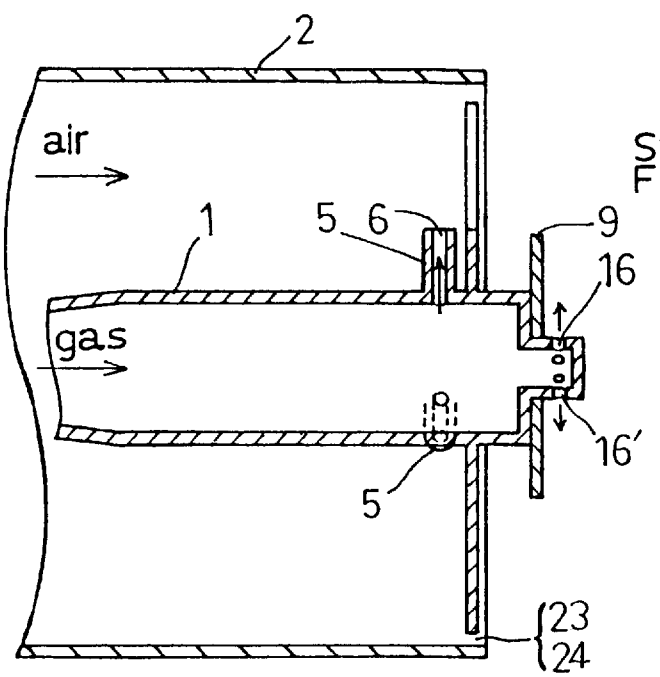
FIG.30A

16'
17
31A
3
28
2
23
24
4
3
27
SEE

31A 3
27
17
21
18

9
17
16'
6
5
SEE FIG. 31D
5
23
24
2
1
air
gas

SEE FIG.32C
SEE FIG.32D
32A
32A
air
gas
1
2
3
4
5
6
8
9
16
17
18
21
23
24
27
28

SEE FIG.33C
SEE FIG.33D
SEE FIG.33E
SEE FIG.33F
SEE FIG.33G
33A
air
gas

SEE FIG.34C
SEE FIG.34D
SEE FIG.34E
SEE FIG.34F
SEE FIG.34G
34A
air
gas

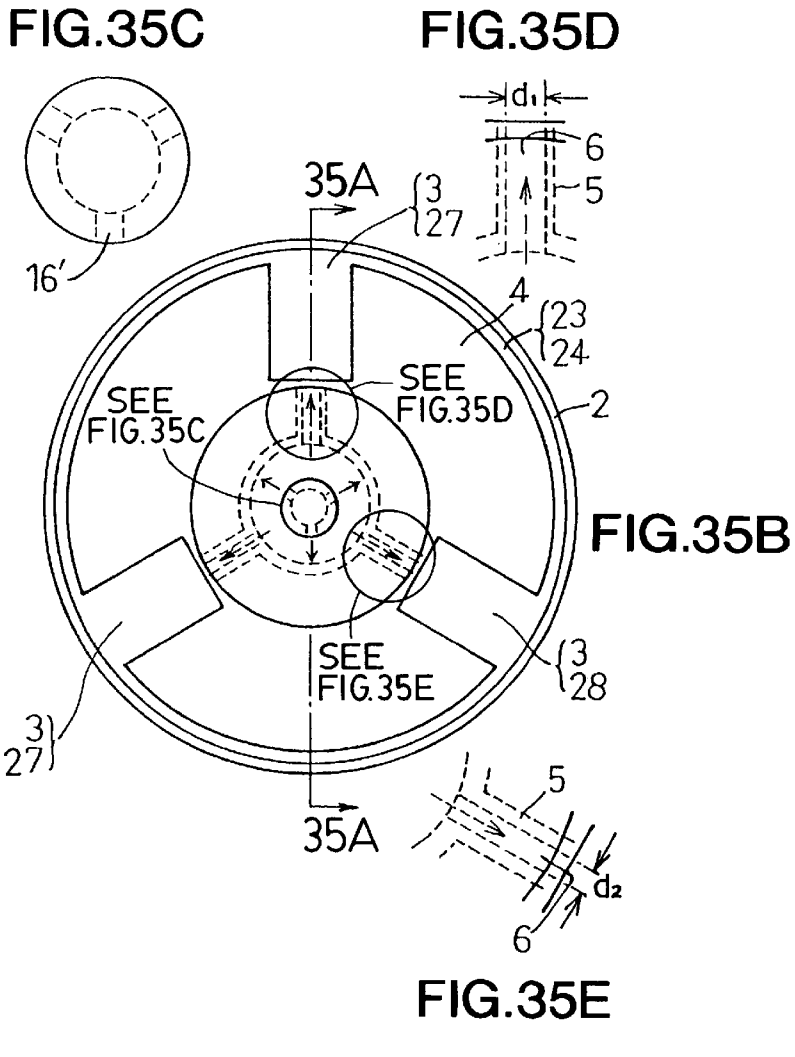
FIG.35D
FIG.35C
FIG.35B
FIG.35E
SEE FIG.35D
SEE FIG.35C
SEE FIG.35E
35A
35A
16'
d1
d2
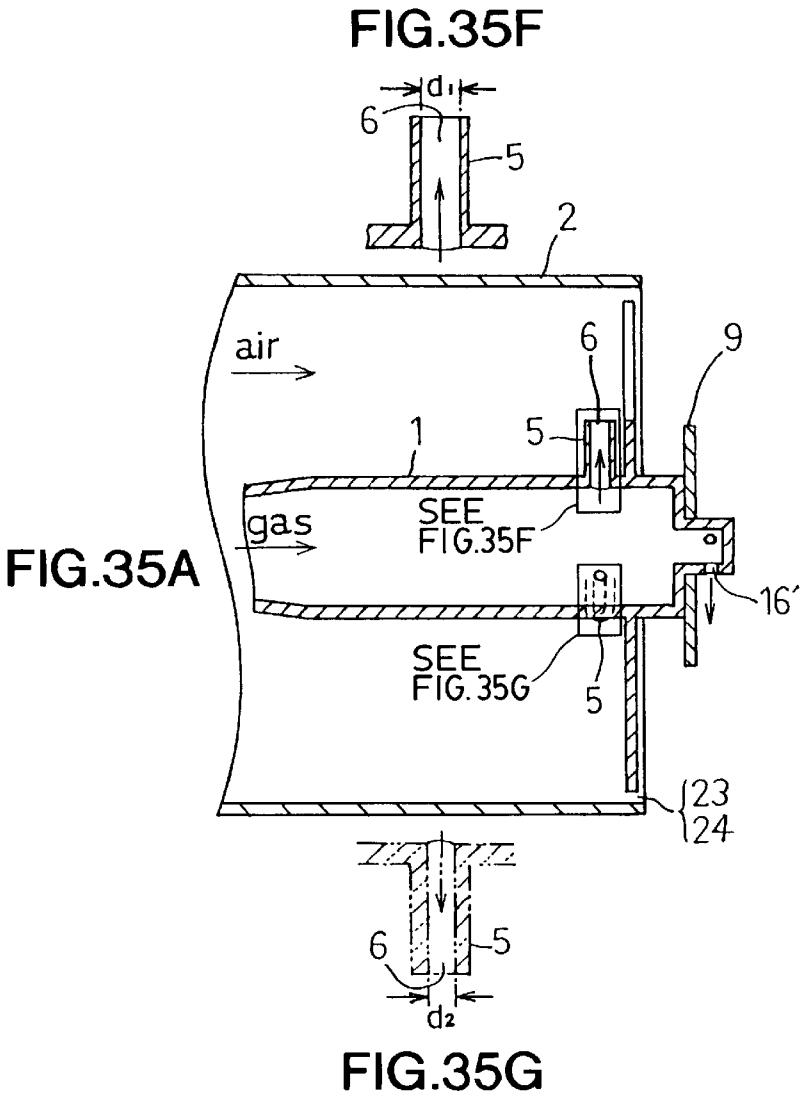
FIG.35F
FIG.35A
FIG.35G
SEE FIG.35F
SEE FIG.35G
air
gas
16'
d1
d2

SEE FIG.36D
SEE FIG.36E
SEE FIG.36C
SEE FIG.36F
SEE FIG.36G
36A
36A
air
gas

SEE FIG.37D
SEE FIG.37E
SEE FIG.37C
SEE FIG.37H
SEE FIG.37F
SEE FIG.37G
37A
air
gas SEE FIG.38D
SEE FIG.38E
SEE FIG.38C
SEE FIG.38H
SEE FIG.38F
SEE FIG.38G
38A
air
gas

LOW NITROGEN OXIDES GENERATING METHOD AND APPARATUS

BACKGROUND OF THE INVENTION

The regulations against the emission of NOx caused by combustion are intensified year after year, and very active technical challenges to decrease NOx emissions are being conducted. NOx generated by combustion includes fuel NOx, prompt NOx and thermal NOx. Among these types of NOx, thermal NOx is produced as the nitrogen molecules in combustion air are oxidized in a high temperature atmosphere, and is highly dependent on the temperature. At higher combustion temperatures, NOx production increases sharply. Thermal NOx is produced without fail if the combustion gas contains nitrogen molecules, and especially when a hydrocarbon-based fuel is burned, the NOx emitted is said to be mostly thermal NOx. A number of methods for decreasing NOx are proposed, including multi-stage combustion methods, exhaust gas recirculation methods, and lean combustion methods. It is also proposed to combine these methods in many ways.

In multi-stage combustion methods, the fuel or combustion air is divided for combustion in two or more stages, and it is intended to achieve low NOx combustion by keeping the flame temperature low or keeping the oxygen concentration low. These combustion methods have a problem in that the multi-stage combustion makes the burner complicated. The exhaust gas recirculation methods are intended to lower the flame temperature or lower the oxygen concentration by mixing part of the combustion gas with air or fuel, and includes forced exhaust gas recirculation methods and self-induced exhaust gas recirculation methods. The forced exhaust gas recirculation methods use a recirculation duct and blower to forcibly mix parts of the combustion gas with combustion air or fuel. These are the most general methods. In the self-induced exhaust gas recirculation methods, a specially devised burner is used to have combustion air flow or fuel flow encapture the combustion gas for mixing to achieve the effect of exhaust gas recirculation by the jet entrainment on encapturement. The self-induced exhaust gas recirculation methods have an advantage in that the effect of exhaust gas recirculation can be obtained without forcibly recirculating the combustion gas, and is free from the complication of the multi-stage combustion methods in that the fuel or combustion air is divided into a plurality of lines. A burner adopting a self-induced exhaust gas recirculation method is disclosed, for example, in Japanese Laid-Open No. 87-17506, and many other burners use the self-induced exhaust gas recirculation methods. However, these methods are limited in their capability to decrease NOx and, further, technical development is necessary to meet the latest severe NOx regulations. Combustion methods developed to maximize the advantage of self-induced exhaust gas recirculation are proposed in Japanese Patent Laid-Open No. 89-300103 and 91-91601, and Japanese Utility Model Laid-Open No. 77-61545. These combustion methods are characterized in that combustion air flow and fuel flow are separately and independently injected into a furnace with a burner without any flame stabilizing mechanism to maximize the effect of self-induced exhaust gas recirculation. In this configuration, the flame is not stabilized in the burner, but is formed at a lifted position, and the combustion begins after part of the combustion gas in the furnace has been sufficiently entrained or encaptured by the fuel flow or combustion air flow. In these combustion methods, the flame is a diffusion flame. Since there is no flame stabilizing mechanism, it can happen that unless the temperature is high, stable ignition cannot be achieved. Therefore, even though the methods are suitable for high temperature furnaces, such as heating furnaces and melting furnaces, they have problems in that the amount of unburned fuel increases and a larger furnace must be used for perfect combustion when they are applied to boilers and low temperature heating furnaces.

Another method for reducing thermal NOx is to use a premixed flame. Premixed combustion at a high increase air ratio can significantly decrease NOx, but a high excess air ratio is likely to decrease the efficiency of combustion and heat transfer. Furthermore, the premixed flame is poor which is disadvantageous.

A method of decreasing thermal NOx by combining the premixed combustion with the effect of self-inducted exhaust gas recirculation was proposed in Japanese Laid-Open No. 91-175211. In this combustion method, the flame stabilizer is a special device, and part of the low temperature combustion gas is mixed with the premixture before the premixture initiates combustion to lower the flame temperature, or to lower the oxygen concentration for decreasing NOx. This combustion method and apparatus presented problems which were observed with other premixed type burners, such as an air-fuel mixer is necessary to generate a premixture for premixed combustion, and since a premixture within inflammable limits is used, the flame may go back into the burner or mixer.

Furthermore, there is a problem in that since part of the combustion gas is mixed with an inflammable premixture, which could result in ignition occurring immediately after the mixing between the premixture and the combustion gas, if the mixed combustion gas is high in temperature, the effect of self-induced exhaust gas recirculation cannot be sufficiently used. Therefore, the flame stabilizer must be specially devised to ensure that the premixture is not ignited when the premixture and part of the combustion gas are mixed.

As described above, self-induced exhaust gas recirculation methods have advantages in that the burner can be simple and low NOx combustion is possible, compared with other low NOx combustion methods, such as multi-stage combustion methods and lean premixed combustion methods. In the combustion methods for decreasing thermal NOx by using self-induced exhaust gas recirculation, if the self-induced exhaust gas recirculation is used to the maximum extent for the diffusion flame, the unusable temperature range useable in the furnace is limited, and the useable combustion equipment is also limited, which is disadvantageous. Moreover, the application of self-induced exhaust gas recirculation to the premixed flame has the problem of flame stability peculiar to the premixed combustion, like back combustion, and requires a more specifically devised flame stabilizer, which is disadvantageous.

SUMMARY OF THE INVENTION

To achieve lower NOx combustion in response to the increasingly intensified NOx regulations for burners, it is desirous to produce a combustion technique for effectively using self-induced exhaust gas recirculation. The present invention was conducted and completed with special attention paid to this point.

An object of the present invention is to provide a low nitrogen oxides generating combustion method and apparatus which utilizes effective self-induced exhaust gas recirculation before the initiation of the combustion of diffusion flames, or allows part of the combustion gas to be entrained by auxiliary fuel flow, air flow and fuel flow before the formation of the diffusion flames to further intensify the recirculation flow of the combustion gas by the diffusion flames or, in addition, which can achieve rich and lean combustion in the diffusion flames for decreasing the generation of NOx by a combination of these measures, and which are excellent in flame stability even in a low temperature atmosphere.

BRIEF DESCRIPTION OF THE DRAWINGS

FIG. 3B is a front sectional view of the entrained flow of air/fuel mixture shown in FIG. 3A; FIG. 3C is a front sectional view of the entrained flow of air/fuel mixture discharging from the nozzle as shown in FIG. 3A;

FIG. 4B is a front cross-sectional view of the entrained flow of discharging air/fuel mixture shown in FIG. 4A; FIG. 4C is a front cross-sectional view of the discharging entrained flow of air/fuel mixture shown in FIG. 4A;

FIG. 8A is a partial cross-sectional view taken along line 8A of FIG. 8B of the embodiment of the present invention as disclosed in Example B illustrating the flow of gases; FIG. 8B is a front view of the embodiment of the present invention as disclosed in Example B, having arrows indicating the direction of gas flow in the nozzle shown in FIG. 8A; FIG. 8C is an enlarged front view of the fuel pipe with the radial fuel injection holes illustrated in dashed lines in FIG. 8B;

FIG. 9A is a partial cross-sectional view taken along line 9A of FIG. 9B of the embodiment of the present invention as disclosed in Example B showing the gas flow; FIG. 9B is a front sectional view of the embodiment of the present invention as disclosed in Example B, having arrows indicating the direction of gas flow as shown in FIG. 9A; FIG. 9C is an enlarged cross-sectional view of the fuel pipe with radial fuel injection holes of FIG. 9A;

FIG. 10A is a partial cross-sectional view taken along line 10A of FIG. 10B of the embodiment of the present invention as disclosed in Example B illustrating the direction of gas flow; FIG. 10B is a front cross-sectional view of the embodiment of the present invention as disclosed in Example B, having arrows indicating the direction of gas flow from the equipment shown in FIG. 10A; FIG. 10C is an enlarged cross-sectional view of the fuel pipe with radial fuel injection holes illustrated in dashed lines in FIG. 10B;

FIG. 14A is a partial cross-sectional view of the embodiment of the present invention as disclosed in Example B, showing the flow of the discharging air/fuel mixture and the state of entrained flow; FIG. 14B is a front cross-sectional view of the flow of the air/fuel mixture shown in FIG. 14A; FIG. 14C is a front cross-sectional view of the flow of the air/fuel mixture shown in FIG. 14A; FIG. 14D is an enlarged cross sectional view of the end of the nozzle showing radial fuel injection holes and central axial fuel injection flow, as shown in FIG. 14A;

FIG. 17A is a partial cross-sectional view taken along line 17A of FIG. 17B of the embodiment of the present invention as disclosed in Example C; FIG. 17B is a front view of the embodiment of the present invention as disclosed in Example C, having sectional arrows indicating the flow of gases of Example C shown in FIG. 17A; FIG. 17C is an enlarged partial view of the end of the fuel pipe with radial fuel injection holes;

FIG. 18A is a partial cross-sectional view taken along line 18A of FIG. 18B of the embodiment of the present invention as disclosed in Example C; FIG. 18B is a front view of the embodiment of the present invention as disclosed in Example C, having sectional arrows indicating the fuel flow in Example C shown in FIG. 18A; FIG. 18C is an enlarged partial front view of the fuel pipe with radial fuel injection holes;

FIG. 19A is a partial cross-sectional view taken along line 19A of FIG. 19B of the embodiment of the present invention as disclosed in Example C; FIG. 19B is a front view of the embodiment of the present invention as disclosed in Example C, having sectional arrows indicating the fuel flow in Example C shown in FIG. 19A; FIG. 19C is an enlarged partial front view of the fuel pipe with radial fuel injection holes;

FIG. 20A is a partial cross-sectional view taken along line 20A of FIG. 20B of the embodiment of the present invention as disclosed in Example C; FIG. 20B is a front view of the embodiment of the present invention as disclosed in Example C, having sectional arrows indicating the fuel flow in Example C shown in FIG. 20A; FIG. 20C is an enlarged partial front view of the fuel pipe with radial fuel injection holes;

FIG. 27A is a partial cross-sectional view taken along line 27A of FIG. 27B of the embodiment of the present invention as disclosed in Example D; FIG. 27B is a front view of the embodiment of the present invention as disclosed in Example D, having sectional arrows indicating the fuel flow of Example D shown in FIG. 27A; FIG. 27C is an enlarged partial front view of the fuel pipe with radial fuel injection holes;

FIG. 28C is an enlarged partial front view of the fuel pipe with radial fuel injection holes;

FIG. 29A is a partial cross-sectional view taken along line 29A of FIG. 29B of the embodiment of the present invention as disclosed in Example D; FIG. 29B is a front view of the embodiment of the present invention as disclosed in Example D, having arrows indicating the fuel flow of Example D as seen in FIG. 29A; FIG. 29C is an enlarged partial front view of the fuel pipe with radial fuel injection holes;

FIG. 30A is a partial cross-sectional view taken along line 30 of FIG. 30B of the embodiment of the present invention as disclosed in Example D; FIG. 30B is a front view of the embodiment of the present invention as disclosed in Example D, having sectional arrows indicating the portion of the embodiment of Example D shown in FIG. 30A; FIG. 30C is an enlarged partial front view of the fuel pipe with radial fuel injection holes;

FIG. 35A is a partial cross-sectional view taken along line 35A of FIG. 35B of the embodiment of the present invention as disclosed in Example D; FIG. 35B is a front view of the embodiment of the present invention as disclosed in Example D, having sectional arrows indicating the fuel flow of Example D shown in FIG. 35A; FIG. 35C is an enlarged partial front view of the fuel pipe with radial fuel injection holes; FIG. 35D is an enlarged partial cross-sectional view of the fuel passage shown in FIG. 35B; FIG. 35E is an enlarged partial cross-sectional view of the fuel passage shown in FIG. 35B; FIG. 35F is an enlarged partial cross-sectional view of the fuel passage shown in FIG. 35A; FIG. 35G is an enlarged partial cross-sectional view of the fuel passage shown in FIG. 35G;

DESCRIPTION OF SYMBOLS

1
Fuel Pipe
2
Air Pipe
3
Slot-like air injecting portion
4
Shielding Plate
5
Base Fuel Injection Pipe
6
Base Fuel Injecting Portion
9
Disc
10
Internal Recirculation Promoting Area
11
Fuel Gas Flow
12
Air Flow
13
Furnace Gas Flow
14
Internal Recirculation Area
15
External Recirculation Area
16, 16
Radial Fuel Injection Hole
17
Central Axial Fuel Injection Hole
18
Annular Hole
19
Radial Fuel Injection Flow
20
Central Axial Fuel Injection Flow
21
Swirl Vane
23
Air Injecting Portion For Forming Annular Air Flow
24
Annular Slit
25
Small Hole
26
Annular Air Flow
27
Rich Flame Forming Injecting Portion
28
Lean Flame Forming Injecting Portion

DETAILED DESCRIPTION OF THE INVENTION

1. Embodiment Disclosed in Example A

One embodiment of the present invention is disclosed in Example A which decreases NOx by injecting air flow from slot-like air injecting portions, and injecting a fuel into the air flow in the direction perpendicular to the air flow just before the air flow is injected from the slot-like air injection portions so that diffusion flames may be formed with the fuel wrapped by air, and burned without being stabilized at the air injecting portions or fuel injection portions to ensure that part of the combustion gas may be entrained by the air flow and the fuel flow before the diffusion flames are formed to effectively achieve the self-induced exhaust gas recirculation.

Figure 1A:
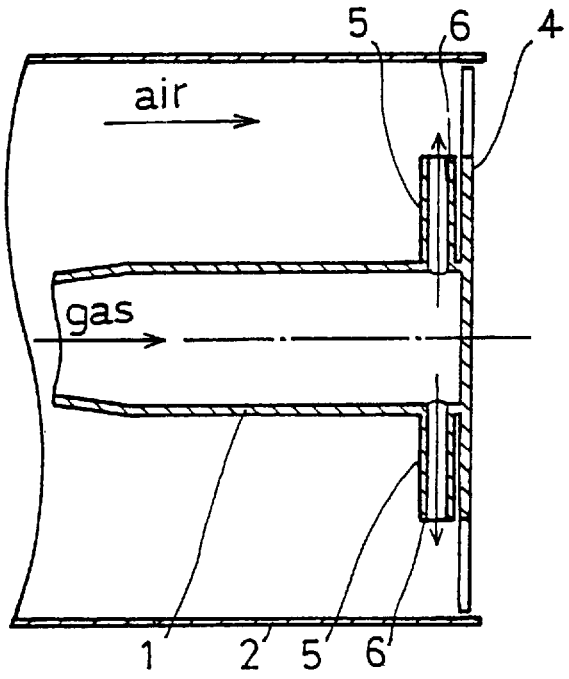
FIG. 1A is a cross-sectional view taken along line 1A of FIG. 1B of the embodiment of the present invention as disclosed in Example A showing the direction of gas flow.
Figure 1B:
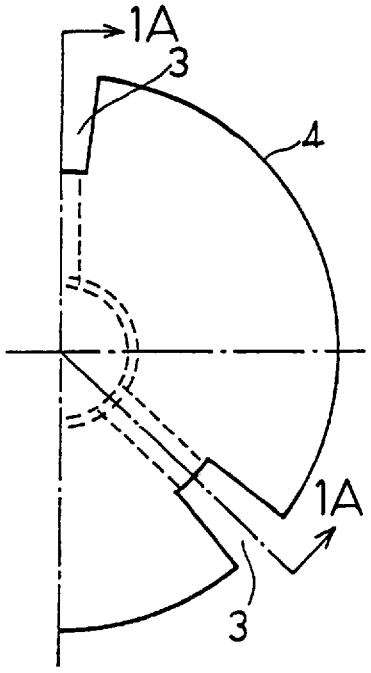
FIG. 1B is a partial front sectional view of the embodiment of the present invention as disclosed in Example A.
Figure 2A:
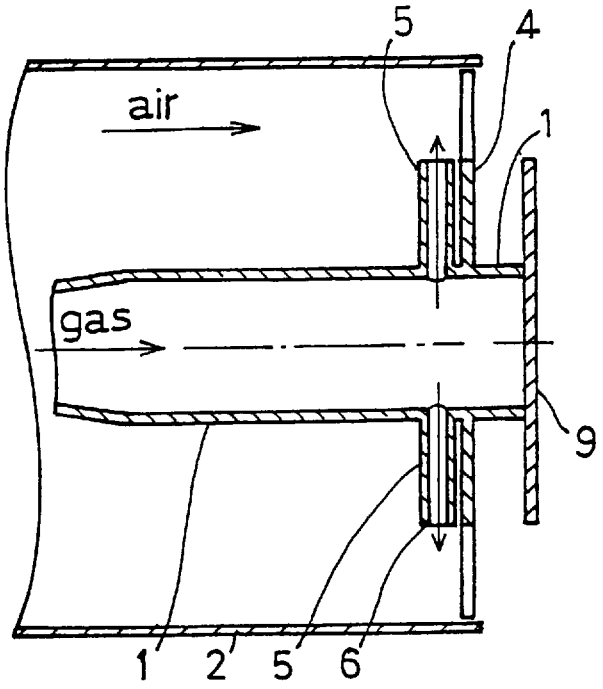
FIG. 2A is a partial cross-sectional view taken along line 2A of FIG. 2B of the embodiment of the present invention as disclosed in Example A illustrating the flow of gases.
Figure 2B:
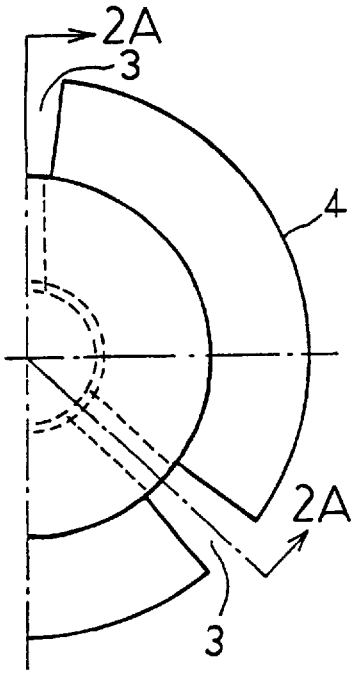
FIG. 2B is a partial front cross-sectional view of the embodiment of the present invention as disclosed in Example A and FIG. 2A.

To achieve this objective, the following means are required. In FIG. 1 symbol 1 denotes a fuel pipe and at the tip of the fuel pipe a shielding plate 4 with a plurality of slot-like air injecting portions 3 is installed around the fuel pipe and in contact with the inside surface of an air pipe 2. At the bases of the plurality of slot-like injecting portions 3, base fuel injection pipes 5 connecting to the fuel pipe 1 are provided, and at the tips of the base fuel injection pipes, radial fuel injecting portions 6 for injecting the fuel in the radial directions are provided. In the case of FIG. 2, the fuel pipe 1 is protruded from the shielding plate 4, and a disc 9 larger in diameter than the fuel pipe 1 is installed at the tip of fuel pipe 1, in order that exhaust gas recirculation promoting area 10 may be formed downstream of the disc 9 as shown in FIG. 4.

In this configuration, the air is injected from the slot-like air injecting portions 3, and into the air flow; the fuel gas is injected from the base fuel injecting portions 6 in the direction perpendicular to the air flow just before the air flow is injected from the slot-like air injecting portions 3. In this case, the ratio of the air flow velocity at the slot-like air injection portions 3 to the fuel gas flow velocity at the base fuel injecting portions 6 must be set at 0.2 or more, preferably 0.2 to about 5. If the ratio is less than 0.2, the fuel gas goes through the air flow to collide with the inside wall of the air pipe 2 being diffused, and flames stabilized in the air pipe 2 are formed. Thus, the ratio cannot be set at less than 0.2.

Figure 3A:
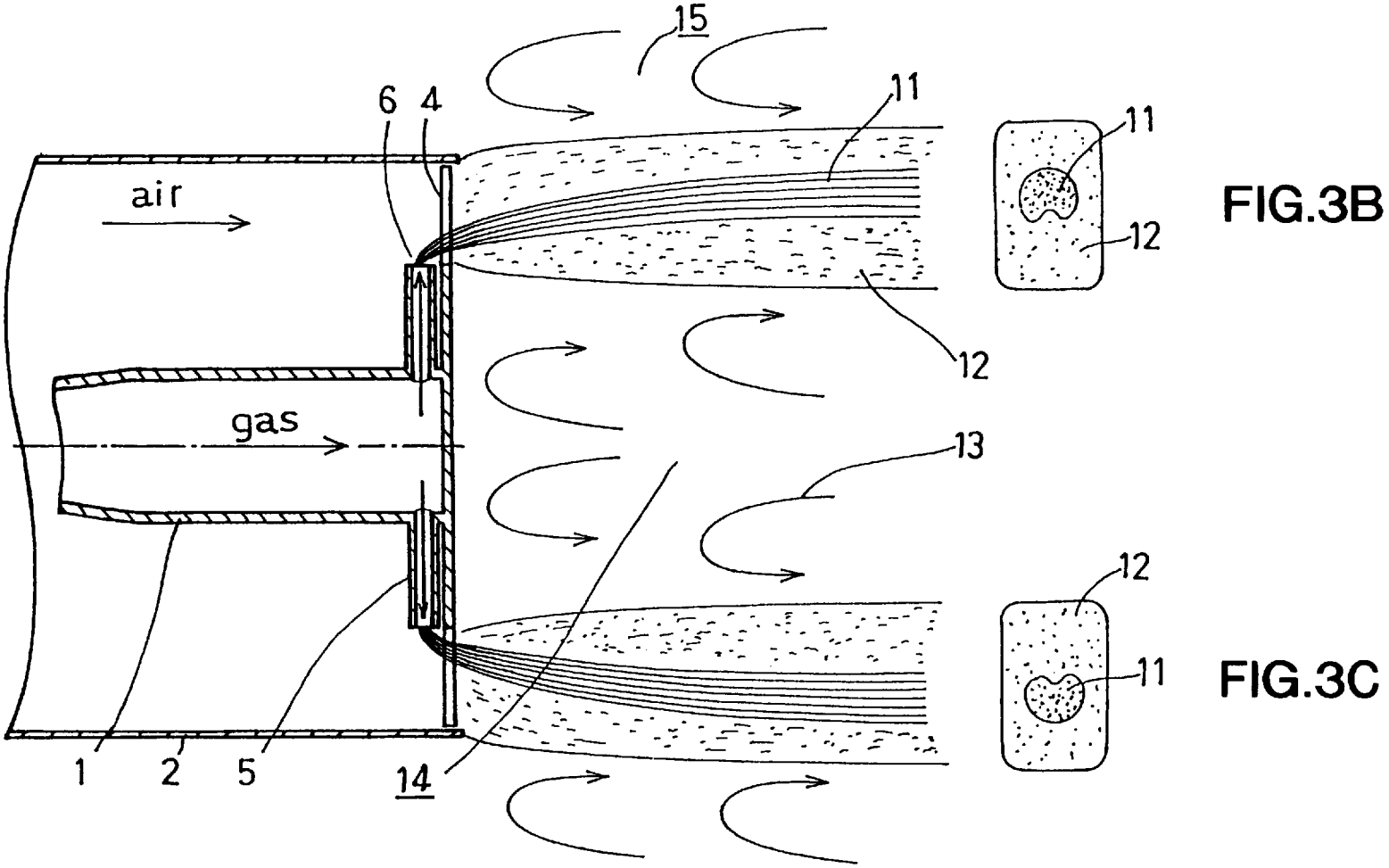
FIG. 3A is a partial cross-sectional view of the embodiment of the present invention as disclosed in Example A, showing the flow of gases and state of the entrained flow of air/fuel mixture discharging from the nozzle.
Figure 4A:
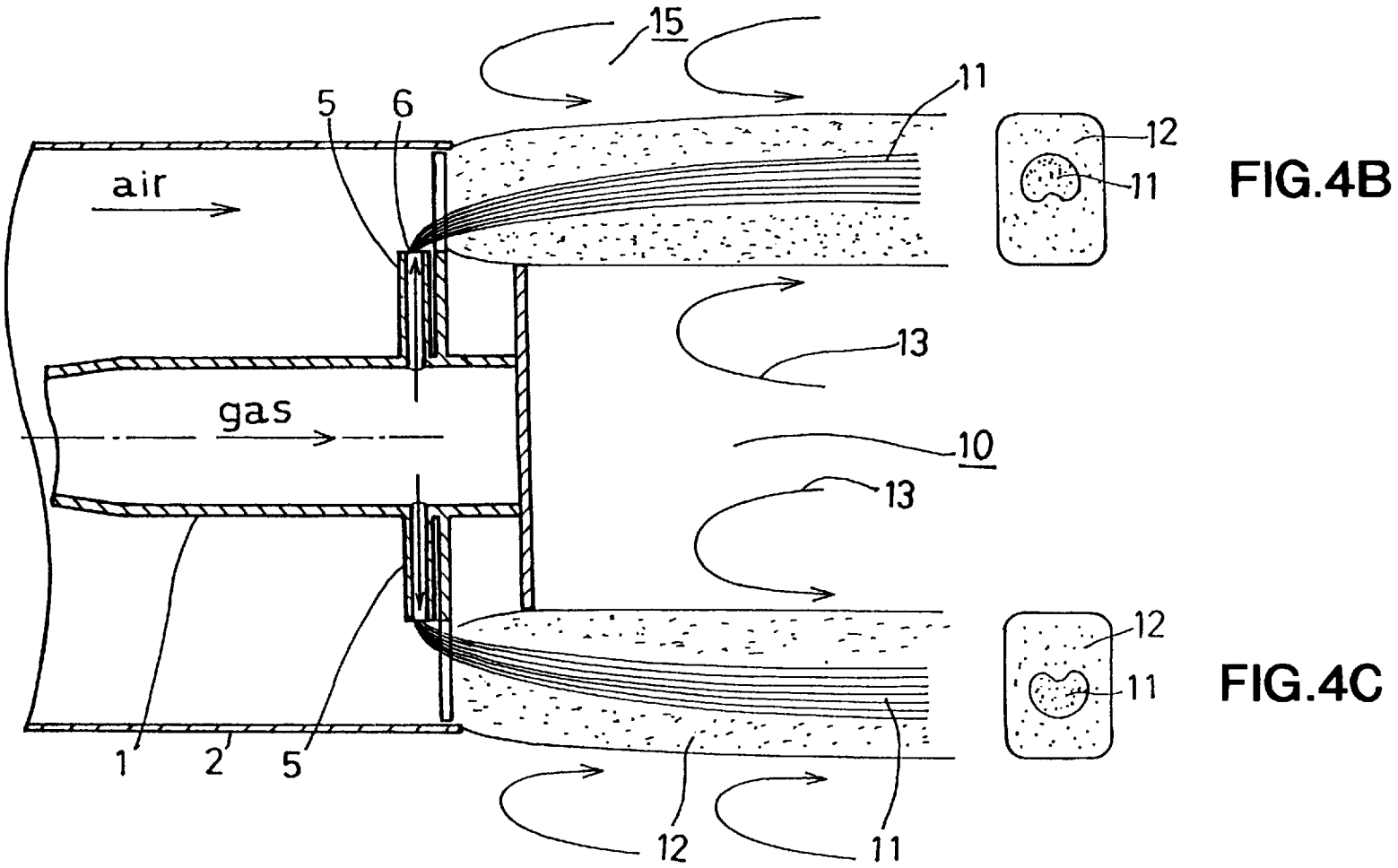
FIG. 4A is a partial cross-sectional view of the embodiment of the present invention as disclosed in Example A, showing the flow of the fluids and state of the entrained flow of air/fuel mixture discharging from the nozzle.

If the ratio is set as specified above, diffusion flames not stabilized at the slot-like air injecting portions 3 are formed, and the fuel gas flow injected in the direction perpendicular to the air flow is wrapped in the air flow 12 as shown in FIGS. 3 and 4. That is, with the fuel gas flow 11 in the center, the air flow 12 is formed around it like a doughnut and around the air flow. The furnace gas flow 13 is formed to be entrained by the air flow as shown by arrows.

In the air flow 12, the high temperature furnace gas flow 13 is diffused and mixed from outside and, simultaneously, the fuel gas flow 11 is diffused and mixed from inside. In the case of ordinary diffusion flames, since the flames are stabilized at air injection holes or fuel gas injection holes, combustion begins before the air flow entrains the surrounding furnace gas. However, in the present invention, since the flow velocity ratio is set as specified above, the flames are not stabilized at the slot-like air injection portions 3 or the base fuel injecting portions 6. In the present invention, the air flow 12 is mixed with the furnace gas flow 13 while being heated, and at the same time, it is gradually mixed with the fuel gas flow 11 inside. The three components develop a favorable mixing state, and when the temperature, fuel concentration and oxygen concentration satisfy the ignition condition, combustion is initiated to form the diffusion flames. In these diffusion flames, since part of the combustion gas is sufficiently mixed with the combustion air, or furthermore the fuel flow before the combustion is initiated, the effect of self-induced exhaust gas recirculation can be obtained to the maximum extent, and the lower flame temperature and the lower oxygen concentration assure remarkably low NOx generation. In this case, an internal recirculation area 14 and an external recirculation area 15 contribute greatly for the entrainment of a large quantity of the furnace gas flow 13.

FIG. 2 shows a case where a disc 9 is additionally installed in the example of FIG. 1. In this case, as shown in FIG. 4, a self-induced exhaust gas recirculation promoting area 10 is formed downstream of the disc 9 to expand the recirculation area 14, thereby remarkably increasing the quantity of the exhaust gas recirculated to give a further higher effect in decrease of NOx. The disc plate 9 inhibits the expansion of the air flow 12 into the internal recirculation area 14 of high temperature to increase the quantity of self-induced exhaust gas recirculation. The increase in entrained flow remarkably promoted the effect of decreasing NOx.

The shielding plate 4 provided around the fuel pipe 1 at the tip of the fuel pipe 1 in the air pipe 2 end in contact with the inside wall of the air pipe 2 has the slot-like air injecting portions 3, and the air for combustion is injected from the slot-like air injecting portions 3. Therefore, the area of jets can be kept large and the combustion gas around the air can be efficiently entrained. Furthermore, since a plurality of slot-like air injecting portions 3 are formed, the air flow 12 is injected separately, and the respective jets entrain the furnace gas flow 13. So, compared to a burner with one air jet, the combustion gas around the air flow can be effectively entrained to enhance the effect of self-induced exhaust gas recirculation. In the portion surrounded by the plurality of combustion air jets, the internal recirculation area 14 is formed, and around the plurality of combustion air jets, the external recirculation area 15 is formed. In both of the recirculation areas, part of the combustion gas is recirculated and entrained by the combustion air jets. This is especially true in the internal recirculation area 14, where high temperature combustion gas is recirculated and, hence, the diffusion flames not stabilized at any portions can be ignited and stability formed.

Figure 5:
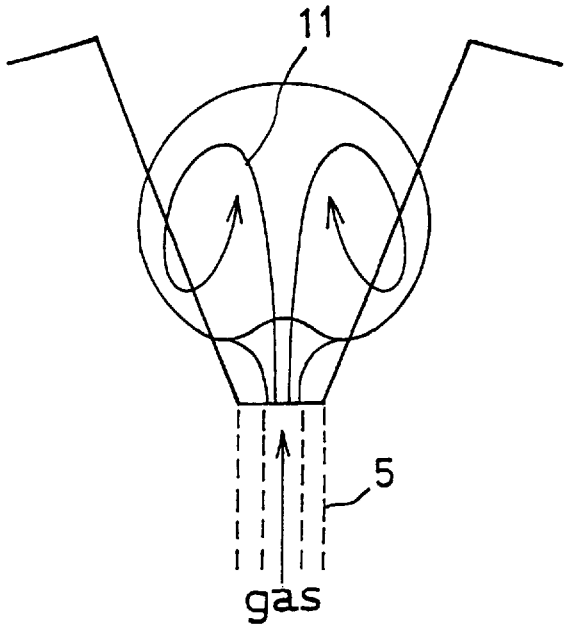
FIG. 5 is a typical view showing the fuel flow in the air flow in Example A.
Figure 6:
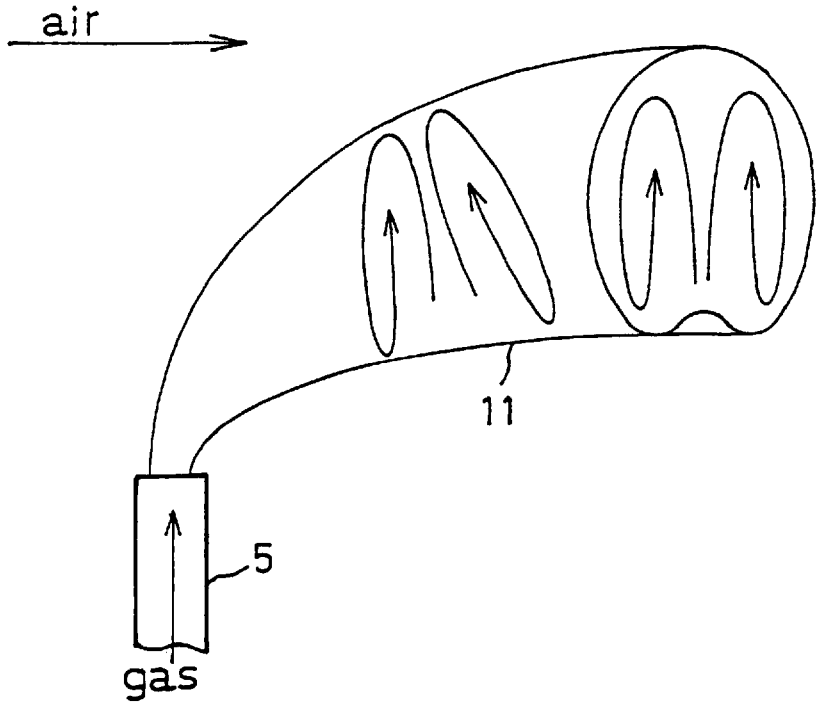
FIG. 6 is a typical view showing the fuel flow in the air flow in Example A.

By injecting the fuel in the direction perpendicular to the air flow and setting the ratio of the air flow velocity to the fuel flow velocity as specified before, the fuel jets can be injected into the centers of the combustion air jets. In this case, as shown in FIGS. 5 and 6, each fuel jet forms twin eddies. The eddies grow according to the progression of mixing between the fuel and the air and according to the distance away from the base fuel injecting portions 6, and also from the slot-like air injecting portions 3. The eddies are mixed with the fuel and the air and, furthermore, gradually entrain the part of the combustion gas entrained by the air. If the combustion gas is entrained by a quantity enough to ignite the fuel, the fuel initiates combustion. The eddies assure the stable ignition of flames even if the flames are not stabilized at the slot-like air injection portions 3 or the base fuel injecting portions 6. If the fuel injected in the direction perpendicular to the air flow 12 destined to pass through the slot-like air injection portions, with the ratio of the combustion air jet flow velocity to the fuel jet flow velocity kept at 0.2 or more, flames can be formed without being stabilized at the injection holes, as remarkably low NOx flames, as described before.

Figure 7:
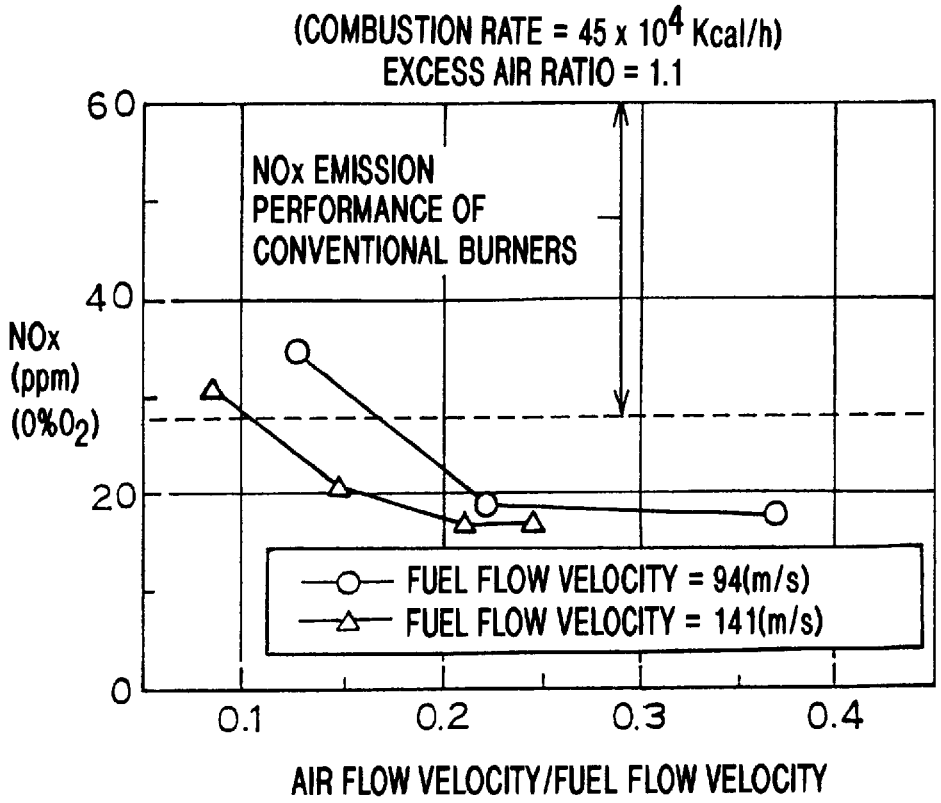
FIG. 7 is a diagram showing the NOx performance of Example A.

FIG. 7 shows the NOx decrease effect of the present invention. From the diagram, it can be seen that if the air/fuel flow velocity ratio is 0.2 or more, NOx can be remarkably decreased compared to convention examples.

2. Embodiment Disclosed in Example B

One embodiment of the present invention is disclosed in Example B which significantly decreases NOx by injecting air flow from slot-like air injecting portions, and injecting a fuel into the air flow in the direction perpendicular to the air flow just before the air flow is injected from the slot-like air injection portions, while separating the fuel for injection. Also, as an auxiliary fuel so that diffusion flames may be formed with fuel wrapped by air and burned without being stabilized at the air injecting portions or fuel injecting portions to ensure that part of the combustion gas may be entrained by the auxiliary fuel flow, the air flow and the fuel flow before the diffusion flames are formed to effectively achieve the self-induced exhaust gas recirculation.

To achieve this objective, the following means are necessary:

In FIG. 8, symbol 1 denotes a fuel pipe, and at the tip of the fuel pipe, a shielding plate 4 with a plurality of slot-like air injecting portions 3 is installed around the fuel pipe and in contact with the inside surface of an air pipe 2. At the base of the plurality of slot-like injecting portions 3, base fuel injection pipes 5 connecting to the fuel pipe 1 are provided, and at the tips of the base fuel injection pipes 5, base fuel injecting portions 6 for injecting the fuel in radial directions are provided. At the tip of the fuel pipe 1, radial fuel injection holes 16 for injecting an auxiliary fuel in the same directions as the injection directions of the base fuel injecting portions 6 are formed, and upstream of the radial fuel injection holes, a disc 9 larger in diameter than the fuel pipe 1 is provided.

In the case of FIG. 9, radial fuel injection holes 16' for injecting the auxiliary fuel in radial directions into the spaces downstream of the areas between the respectively adjacent slot-like air injecting portions are formed.

In the case of FIG. 10, the radial fuel injection holes 16' for injecting the auxiliary fuel in radial directions into the spaces downstream of the areas between the slot-like air injecting portions 3, and the radial fuel injection holes 16 for injecting the auxiliary fuel in the same directions as the injection directions of the base fuel injecting portions 6 are formed.

Figures 11A, 11B, 11C, 11D:
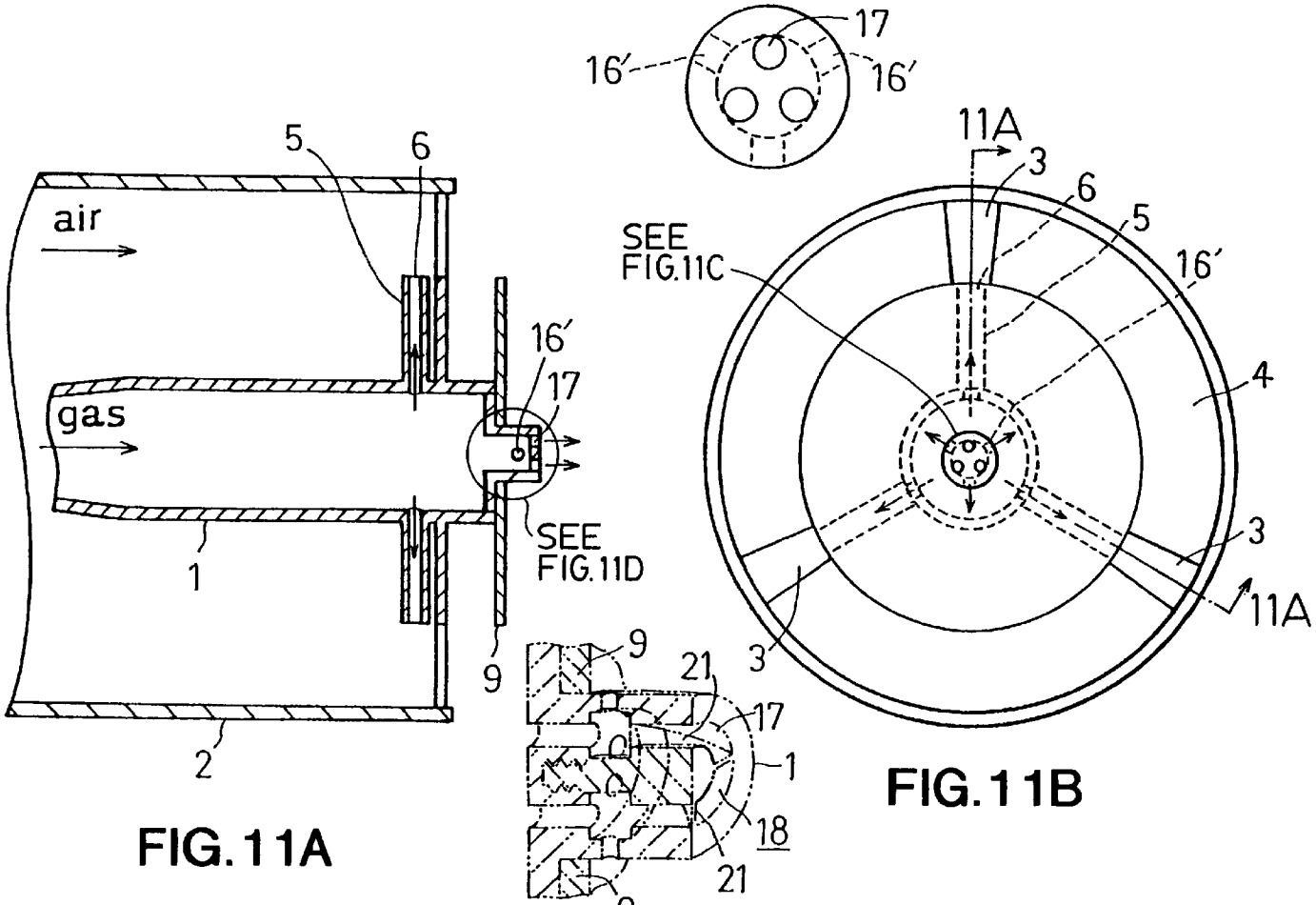
FIG. 11A is a partial cross-sectional view taken along line 11A of FIG. 11B of the embodiment of the present invention as disclosed in Example B showing the direction of gas flow.
FIG. 11B is a front view of the embodiment of the present invention as disclosed in Example B, having arrows indicating the direction of gas flow from the fuel pipe shown in FIG. 11A.
FIG. 11C is an enlarged front view of the fuel pipe with central axial fuel injection holes illustrated in FIGS. 11A and 11B.
FIG. 11D is an enlarged partial cross-sectional view of the end of the fuel injection nozzle shown in FIGS. 11A–11C.

In the case of FIG. 11, the radial fuel injection holes 16' for injecting the auxiliary fuel in radial direction into the spaces downstream of the areas between the slot-like air injecting portions 3, and a central axial fuel injection holes 17 for injecting the auxiliary fuel in the direction of the central axis of the fuel pipe 1 are formed.

Figures 12A, 12B, 12C, 12D:
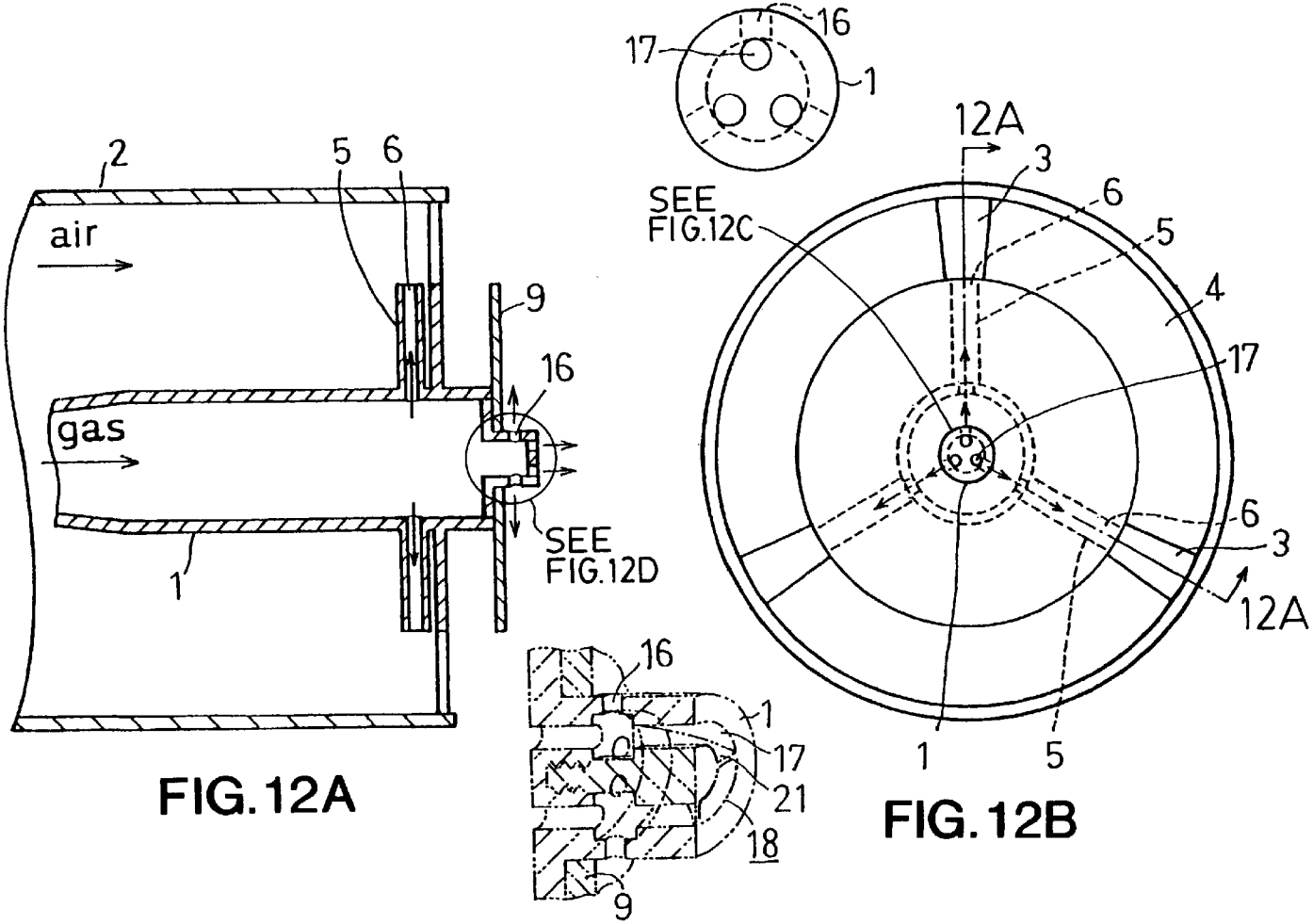
FIG. 12A is a partial cross-sectional view taken along line 12A of FIG. 12B of the embodiment of the present invention as disclosed in Example B showing the direction of gas flow.
FIG. 12B is a front view of the embodiment of the present invention as disclosed in Example B, having sectional arrows indicating the direction of gas flow in Example A as shown in FIG. 12A.
FIG. 12C is an enlarged view of the fuel pipe with radial fuel injection holes and central axial fuel injection holes.
FIG. 12D is an enlarged cross-sectional view of the embodiment of the present invention as shown in FIG. 12A illustrating the end of the fuel nozzle.

In the case of FIG. 12, the radial fuel injection holes 16 for injecting the auxiliary fuel in the same directions as the injection directions of the base fuel injecting portions 6, and a central axial fuel injection holes 17 for injecting the auxiliary fuel in the direction of the central axis of the fuel pipe 1 are formed.

The form of the central axial fuel injection hole 17 can also be an annular hole 18 as shown in FIG. 18. Symbol 21 denotes a swirl vane installed in the annular hole 18.

In the above configuration, air is injected from the slot-like air injecting portions 3, and into the air flow. The fuel gas is injected from the base fuel injecting portions 6 in the direction perpendicular to the air flow just before the air flow is injected from the slot-like air injecting portions 3. In this case, the ratio of the air flow velocity at the slot-like air injecting portions 3 to the fuel gas flow velocity at the base fuel injecting portions 6 must be set at 0.2 or more, preferably 0.2 to about 5. If the ratio is less than 0.2, the fuel gas goes through the air flow to collide with the inside wall of the air pipe 2, being diffused, and flames stabilized in the air pipe 2 are formed. Thus, the ratio cannot be set to less than 0.2.

Figures 13A, 13B, 13C, 13D:
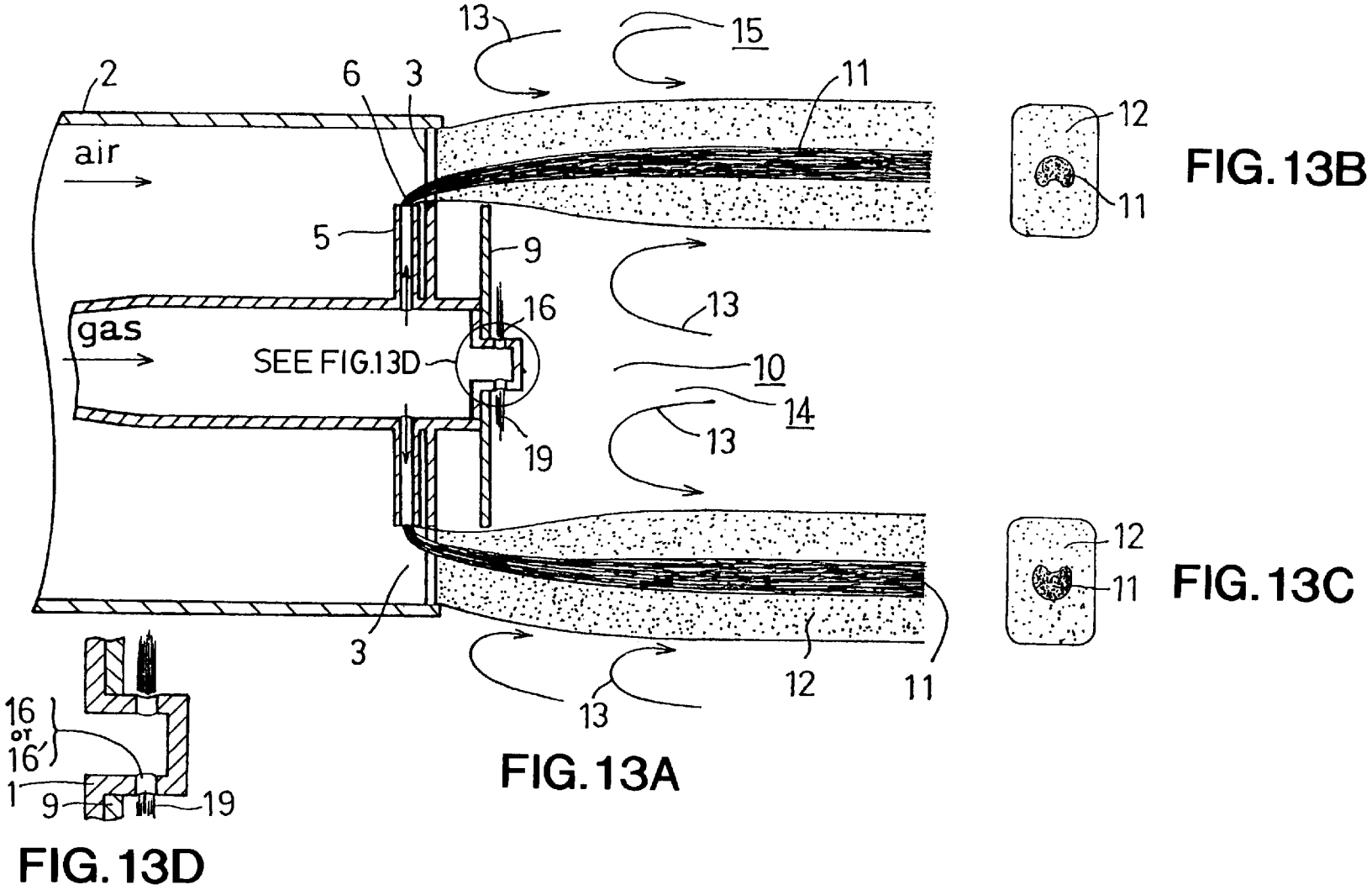
FIG. 13A is a partial cross-sectional view of the embodiment of the present invention as disclosed in Example B, showing the flow of the air/fuel mixture and the state of entrained flow.
FIG. 13B is a front cross-sectional view of the flow of discharging air/fuel mixture shown in FIG. 13A.
FIG. 13C is a front cross-sectional view of the flow of the discharging air/fuel mixture shown in FIG. 13A.
FIG. 13D is an enlarged cross sectional-view of the end of the nozzle showing radial fuel flow, as shown in FIG. 13A.

If the ratio is set as specified above, diffusion flames stabilized at the slot-like injecting portions 3 are not formed, and the fuel gas flow injected in the direction perpendicular to the air flow is wrapped in the air flow 12 as shown in FIGS. 13 and 14. In this case, if radial fuel injection flow 19 and, as required, central axial fuel injection flow 20 are injected from the radial fuel injection holes 16 and/or 16' and, as required, from the central axial fuel injection hole 17, as the auxiliary fuel toward the furnace combustion gas flow 13, and the internal recirculation area 14, etc., the radial fuel injection flow 19 and, as required, the central axial fuel injection flow 20 entrains a large amount of combustion gas before combustion to further promote the self-induced exhaust gas recirculation in the internal recirculation area 14, thereby forming the internal recirculation promoting area 10 to further decrease NOx.

That is, with the fuel gas flow 11 in the center, the air flow 12 is formed around it like a doughnut. The furnace gas flow 13, and the radial fuel injection flow 19, and as required, the central axial fuel injection flow 20 each formed by the auxiliary fuel entraining the furnace gas 13' are formed around the air flow 12, as shown by arrows. In the air flow 12, the high temperature furnace gas flow 13 is diffused and mixed from outside, and simultaneously, the fuel gas flow 11 is diffused and mixed from inside.

In the case of ordinary diffusion flames, since the flames formed are stabilized at air injection holes or fuel gas injection holes, combustion begins before the air flow entrains the surrounding furnace gas. However, in the present invention, since the flow velocity ratio is set as specified above, the flames are not stabilized at the slot-like air injecting portions 3 or the base fuel injecting portions 6. In the present invention, the air flow 12 is mixed with the furnace gas flow 13 while being heated, and at the same time, it is gradually mixed with the fuel gas flow 11 and the radial fuel injection flow 19 and, as required, the central axial fuel injection flow 20 respectively formed by the auxiliary fuel moving inside it. The four components develop a favorable mixed state, and when the temperature, fuel concentration and oxygen concentration satisfy the ignition condition, combustion is initiated to form the diffusion flames. In these diffusion flames, since part of the combustion gas is sufficiently mixed with the combustion air and the fuel flow, or furthermore the auxiliary fuel flow before the combustion is initiated, the effect of self-induced exhaust gas recirculation can be obtained to the maximum extent, and the lower flame temperature and the lower oxygen concentration assure remarkably low NOx generation. In this case, the internal recirculation area 14 and the external recircular area 15 greatly contribute to the entrainment of a large quantity of the furnace gas flow 13.

In the above combustion, if the central axial fuel injection hole 17 is formed as the annular hole 18, the auxiliary fuel is injected annularly to increase the contact area with the furnace gas for remarkably improving the self-induced exhaust gas recirculation effect to promote the NOx decrease effect. Furthermore, if a swirl vane 21 is installed in the annular hole 18, the fuel is injected annularly in a swirl to increase the entrained furnace gas for further importing the self-induced exhaust gas recirculation effect, thereby promoting the NOx decrease effect.

In the above combustion, in the case of FIG. 8, since the radial fuel injection flow 19 is injected as the auxiliary fuel from the radial fuel injection hole 16 in the same directions as the injection directions of the base fuel injecting portions 6, the auxiliary fuel and the furnace gas are mixed before combustion, as described before, to promote the self-induced exhaust gas recirculation, thereby further promoting the NOx decrease effect in synergism with said combustion.

In the above combustion, in the case of FIG. 9, since the auxiliary fuel is injected from the radial fuel injection holes 16' in radial directions into the spaces downstream of the areas between the respectively adjacent slot-like air injecting portions 3, the auxiliary fuel and the furnace gas are mixed before combustion as described above to promote the self-induced exhaust gas recirculation, thereby further promoting the NOx decrease effect in synergism with said combustion.

In the above combustion, in the case of FIG. 10, since the auxiliary fuel is injected from the radial fuel injection holes 16' in radial directions into the spaces downstream of the areas between the respectively adjacent slot-like air injection portions 3, while the auxiliary fuel is simultaneously injected from the radial fuel injection holes 16 in the same directions as the injection directions of the base fuel injecting portions 6, the auxiliary fuel and the furnace gas are mixed before combustion as described before to promote the self-induced exhaust gas recirculation, thereby further promoting NOx decrease effect in synergism with said combustion.

In the above combustion, in the case of FIG. 11, the auxiliary fuel is injected from the radial fuel injection holes 16' in radial directions into the spaces downstream of the areas between the respectively adjacent slot-like air injection portions 3, while the auxiliary fuel is simultaneously injected from the central axial fuel injection holes 17 in the central axial direction of the fuel pipe 1. The auxiliary fuel and the furnace gas are mixed before combustion, as described before, to promote the self-induced exhaust gas recirculation, thereby further promoting NOx decrease effect in synergism with said combustion.

In the above combustion, in the case of FIG. 12, since the auxiliary fuel is injected from the radial fuel injection holes 16' in the same direction as the injection directions of the base fuel injecting portions 6 while the auxiliary fuel is simultaneously injected from the central axial fuel injection holes 17 in the central axial direction of the fuel pipe 1, the auxiliary fuel and the furnace gas are mixed before combustion as described before to promote the self-induced exhaust gas recirculation, thereby further promoting NOx decrease effect in synergism with said combustion.

Figure 15:
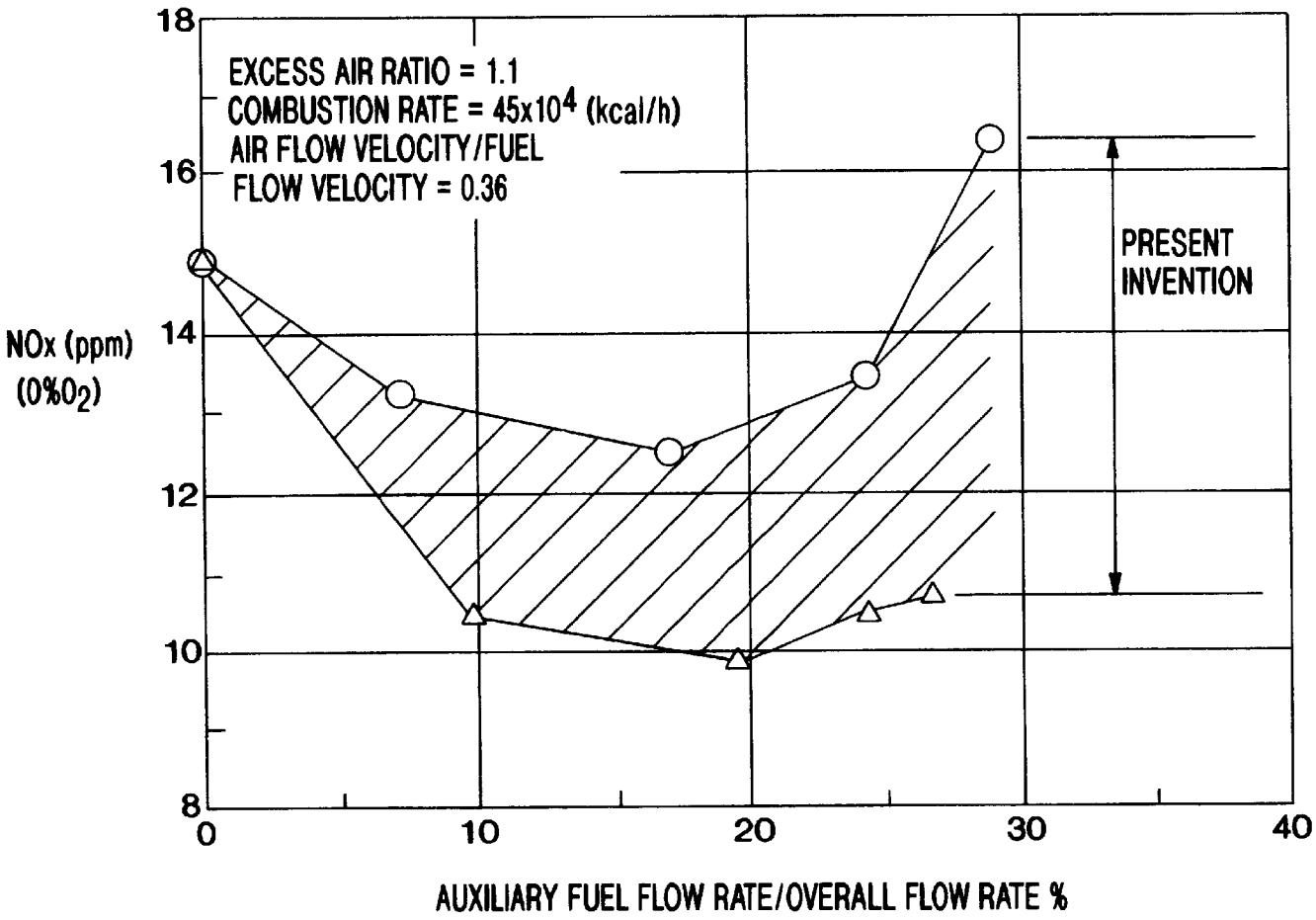
FIG. 15 is a diagram showing the NOx performance as the effect of the auxiliary fuel injection in Example B.
Figure 16:
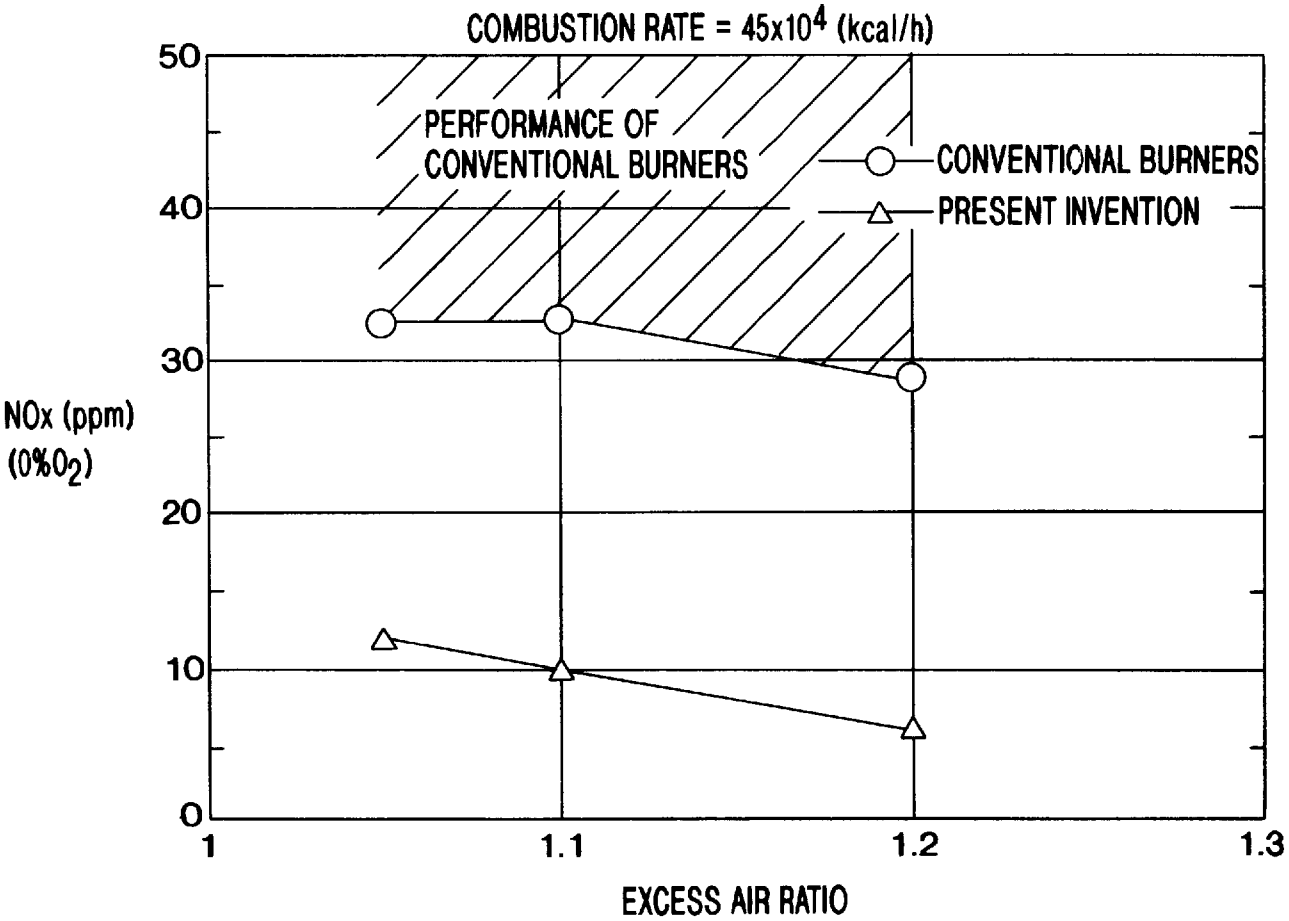
FIG. 16 is a diagram showing the NOx performance for comparing Example B with the conventional methods.

FIG. 15 shows the NOx decrease effect of this example. From FIG. 15 and FIG. 16 showing a comparison with the conventional examples, it can be seen that if the air/fuel flow velocity ratio is 0.2 or more, and if 10 to 20% of the overall fuel is injected as the auxiliary fuel, NOx can be decreased remarkably.

3. Embodiment Disclosed in Example C

One embodiment of the present invention is disclosed in Example C which greatly decreases NOx by injecting air flow from slot-like air injecting portions, and injecting a fuel into the air flow in the direction perpendicular to the air flow just before the air flow is injected from the slot-like air injection portions, while separating the fuel for injection. Also, as an auxiliary fuel so that diffusion flames may be formed with fuel wrapped by air and burned without being stabilized at the air injecting portions or fuel injecting portions to ensure that part of the combustion gas may be entrained by the auxiliary fuel flow, the air flow and the fuel flow before the diffusion flames are formed to effectively achieve the self-induced exhaust gas recirculation, and furthermore, injecting air from an air injecting portion for forming annular air flow to form annular air flow downstream of a shielding plate so that a powerful negative pressure portion may be formed inside the annual air flow to increase the back flow or recirculation flow of the furnace combustion gas for further promotion of internal recirculation, thereby forming a powerful ignition source by the recirculation of high temperature furnace combustion gas, thus achieving excellent flame ignition and stable combustion, and effectively promoting said self-induced exhaust gas recirculation combustion.

To achieve this objective, the following means are required.

In FIGS. 17 and 18, symbol 1 denotes a fuel pipe installed in an air pipe 2, and a shield plate 4 provided with a plurality of slot-like air injecting portions 3 is installed around the fuel pipe 1 at the tip of the fuel pipe. Around or inside the edge of the shielding plate 4, an air flow injection portion 23 for forming annular air flow is provided, and at the base of the plurality of slot-like air injecting portions 3, base fuel injection pipes 5 connecting to the fuel pipe 1 are installed. At the tips of the base fuel injection pipes 5, base fuel injecting portions 6 for injecting fuel in radial directions are provided. At the tip of the fuel pipe 1, radial fuel injection holes 16 for injecting the auxiliary fuel in the same directions as the injection directions of the base fuel injecting portions 6 are provided, and disc 9 larger in diameter than the fuel pipe 1 is provided upstream of the radial fuel injection holes 16. The air injection portion 23 for forming annular air flow can be formed as an annular slit 24 between the air pipe 2 and the shielding plate 4, or by arranging small holes 25 annularly inside the edge of the shielding plate 4. In FIGS. 19 through 22 the annular slit 24 is only expressed for the sake of convenience.

In the case of FIG. 19, radial fuel injection holes 16' for injecting the auxiliary fuel in radial directions into the spaces downstream of the areas between the respectively adjacent slot-like injecting portions 3 are provided.

In the case of FIG. 20, the radial fuel injection holes 16' for injecting the auxiliary fuel in radial directions in the spaces downstream of the areas between the respectively adjacent slot-like air injecting portions 3 are provided, and radial fuel injection holes 16 for injecting the auxiliary fuel in the same directions as the injection directions of the base fuel injecting portions 6 are provided.

Figures 21A, 21B, 21C, 21D:
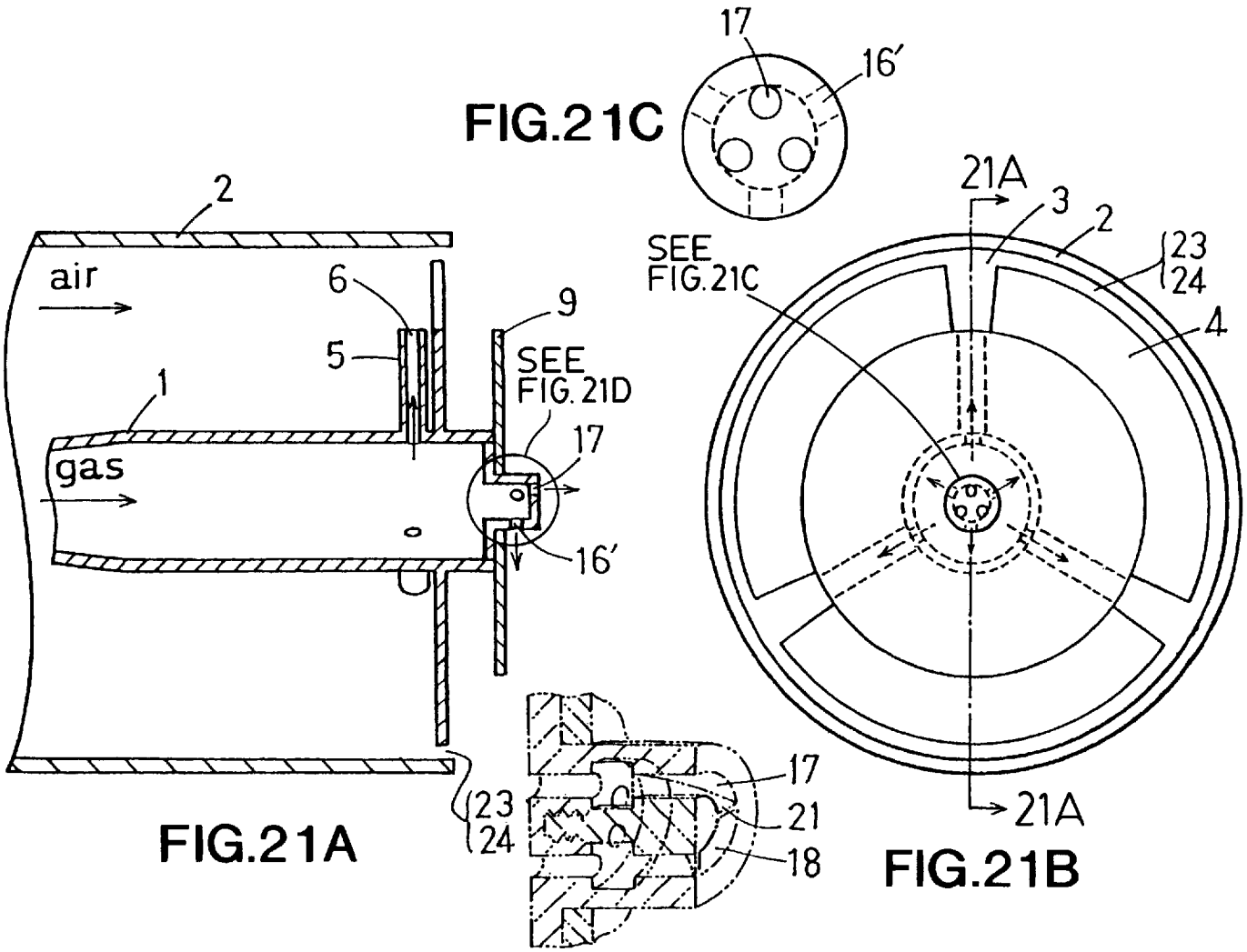
FIG. 21A is a partial cross-sectional view taken along line 21A of FIG. 21B of the embodiment of the present invention as disclosed in Example C.
FIG. 21B is a front view of the embodiment of the present invention as disclosed in Example C, having sectional arrows indicating the fuel flow in Example C shown in FIG. 21A.
FIG. 21C is an enlarged partial front view of the fuel pipe with radial fuel injection holes.
FIG. 21D is an enlarged cross-sectional view of the end of the nozzle in one embodiment of the present invention as shown in FIG. 21A.

In the case of FIG. 21, radial fuel injection holes 16' for injecting the auxiliary fuel in radial directions into the spaces downstream of areas between the respectively adjacent slot-like air injecting portions 3, and a central axial fuel-injection holes 17 for injecting the auxiliary fuel in the central axial direction of the fuel pipe 1 are provided.

Figures 22A, 22B, 22C, 22D:
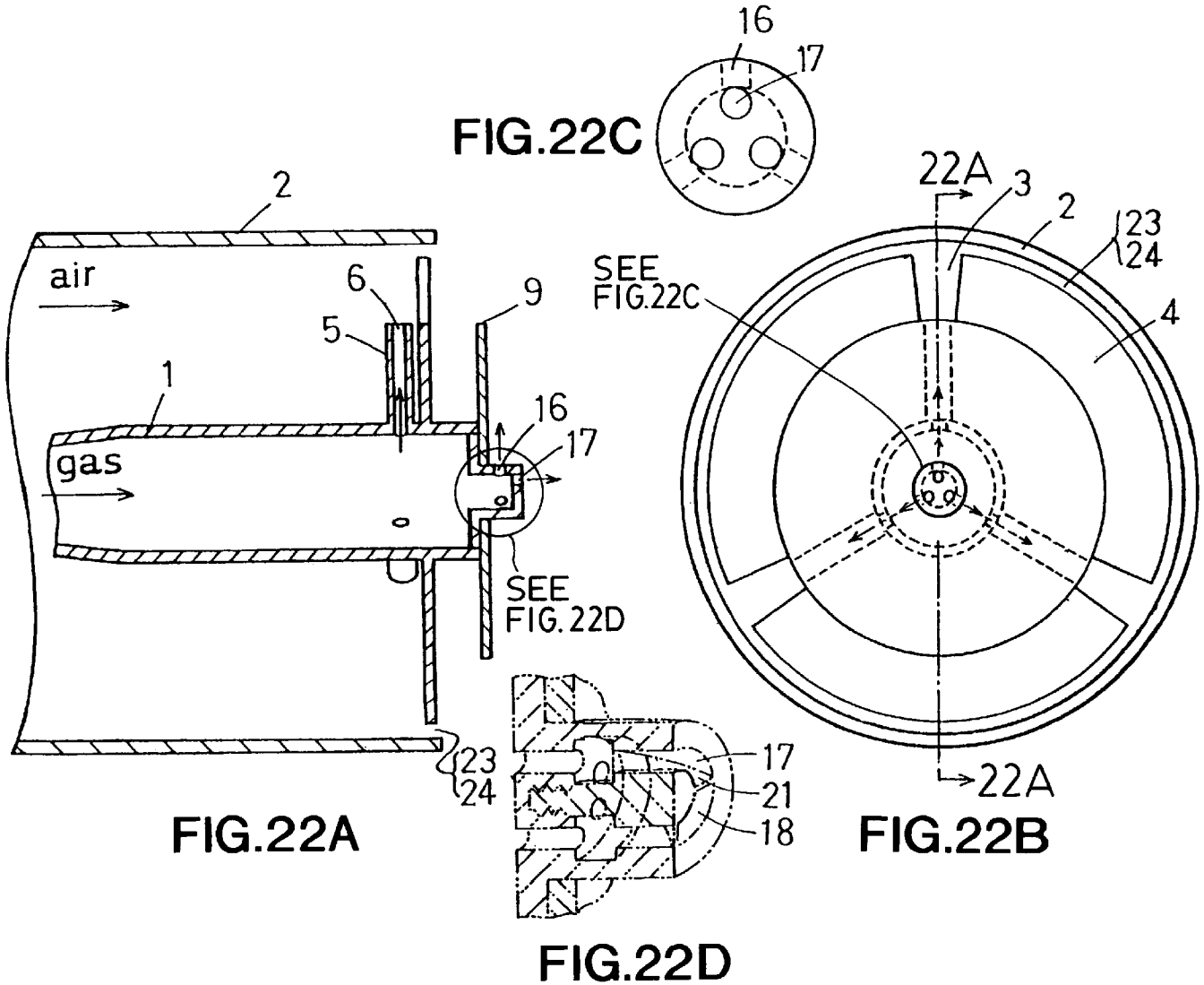
FIG. 22A is a partial cross-sectional view taken along line 22A in FIG. 22B of the embodiment of the present invention as disclosed in Example C.
FIG. 22B is a front view of the embodiment of the present invention as disclosed in Example C, having sectional arrows indicating the fuel flow of Example C shown in FIG. 22A.
FIG. 22C is an enlarged partial front view of the end of the fuel pipe with radial fuel injection holes.
FIG. 22D is an enlarged cross-sectional view of the end of the nozzle in one embodiment of the present invention as shown in FIG. 22A.

In the case of FIG. 22, radial fuel injection holes 16 for injecting the auxiliary fuel in the same directions as the injection directions of the base fuel injecting portions 6, and a central axial fuel injection holes 17 for injecting the auxiliary fuel in the central axial direction of the fuel pipe 1 are provided.

The central axial fuel injection holes 17 can also be formed like a annular hole 18 as illustrated. Symbol 21 denotes a swirl vane installed in the annular hole 18.

Figures 23A, 23B, 23C:
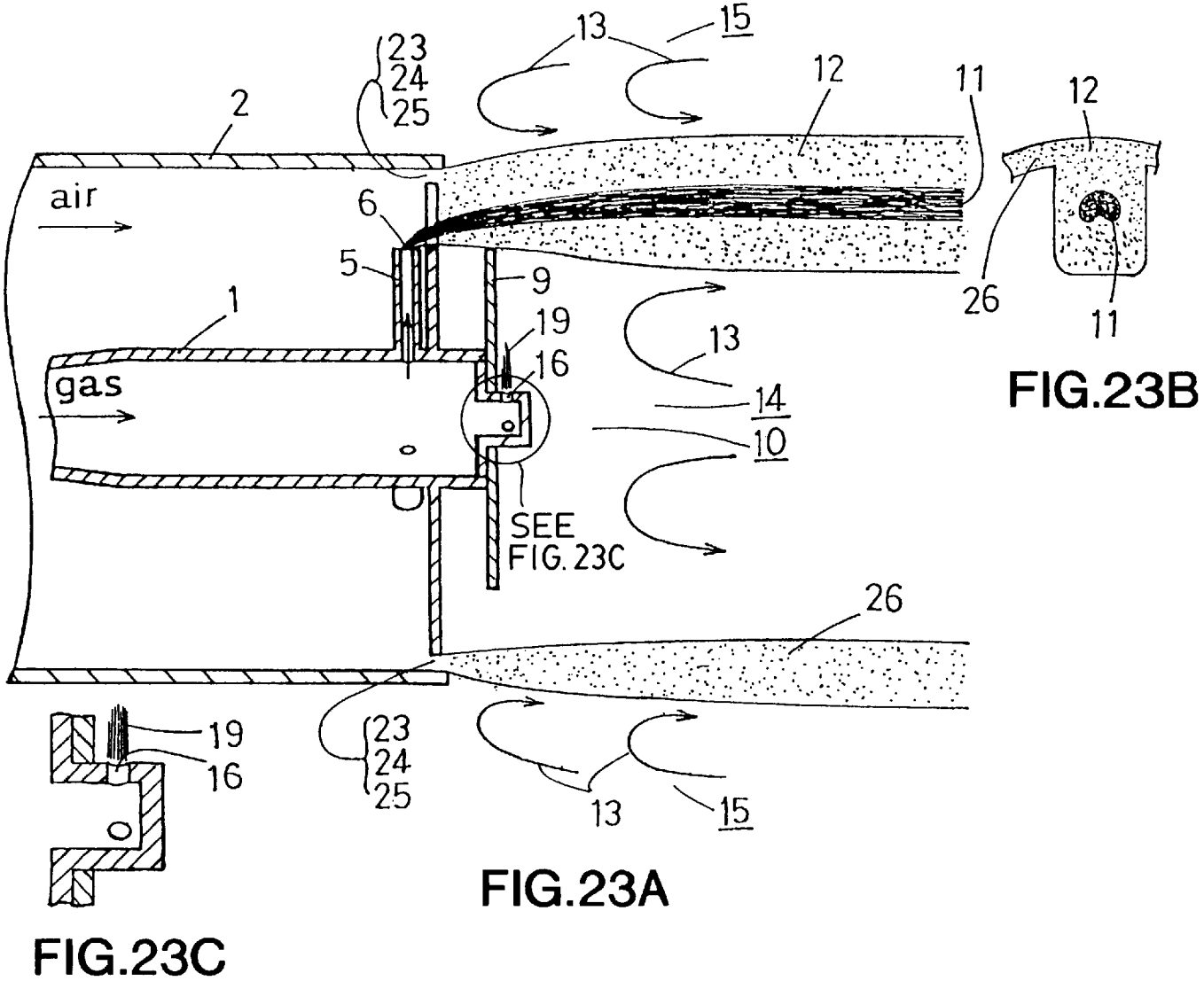
FIG. 23A is a partial cross-sectional view of one embodiment of the present invention as disclosed in Example C, showing the flow of the air/fuel mixture and the state of entrained flow.
FIG. 23B is a partial front cross-sectional view of the flow of the air/fuel mixture shown in FIG. 23A.
FIG. 23C is an enlarged cross sectional view of the end of the nozzle showing radial fuel injection holes as shown in FIG. 23A.
Figures 24A, 24B, 24C:
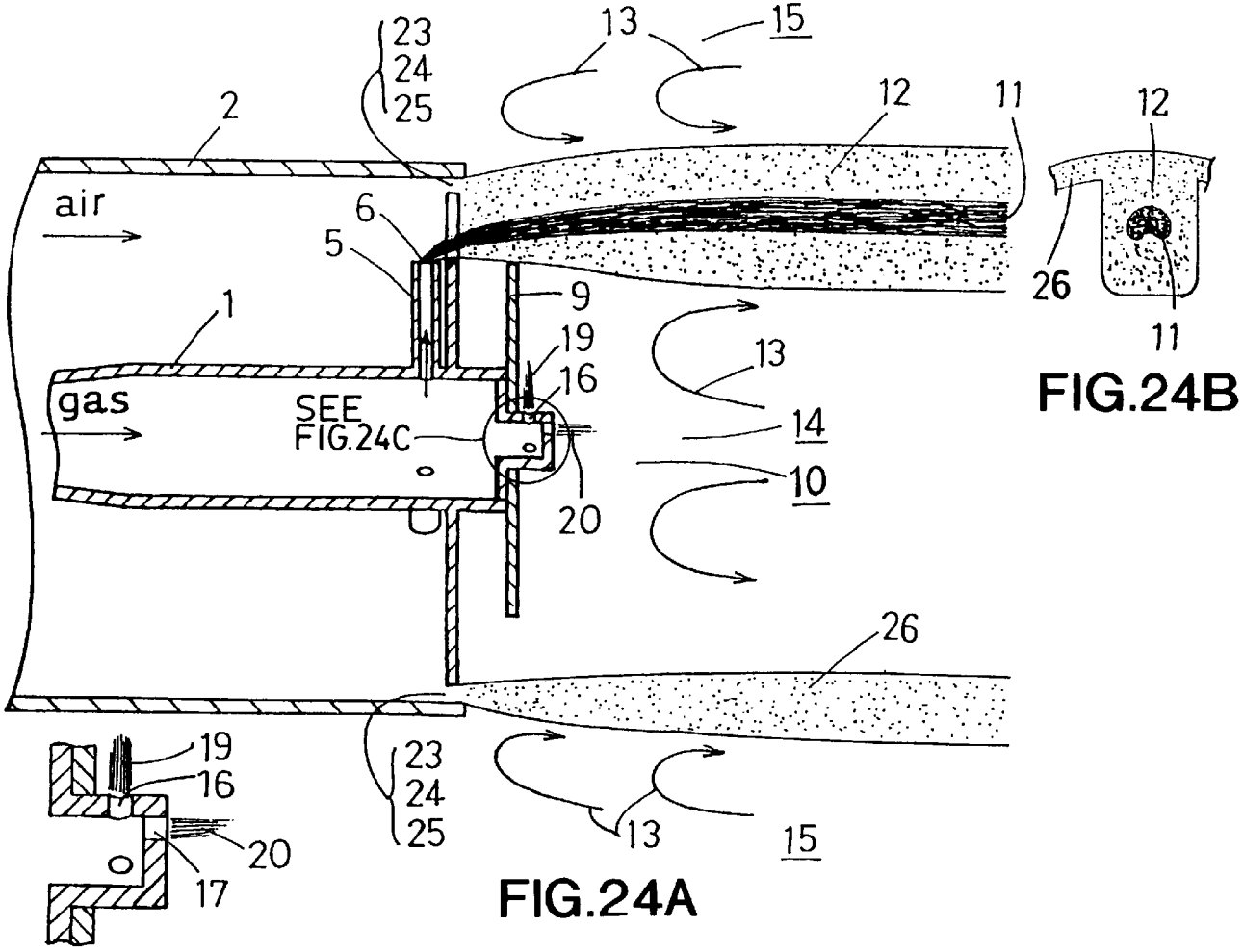
FIG. 24A is a partial cross-sectional view of the embodiment of the present invention as disclosed in Example C, showing the flow of the air/fuel mixture and the state of entrained flow.
FIG. 24B is a partial cross-sectional front view of the flow of the air/fuel mixture shown in FIG. 24A.
FIG. 24C is a partial enlarged cross sectional view of the end of the nozzle having radial fuel injection holes as shown in FIG. 24A.
Figure 25:
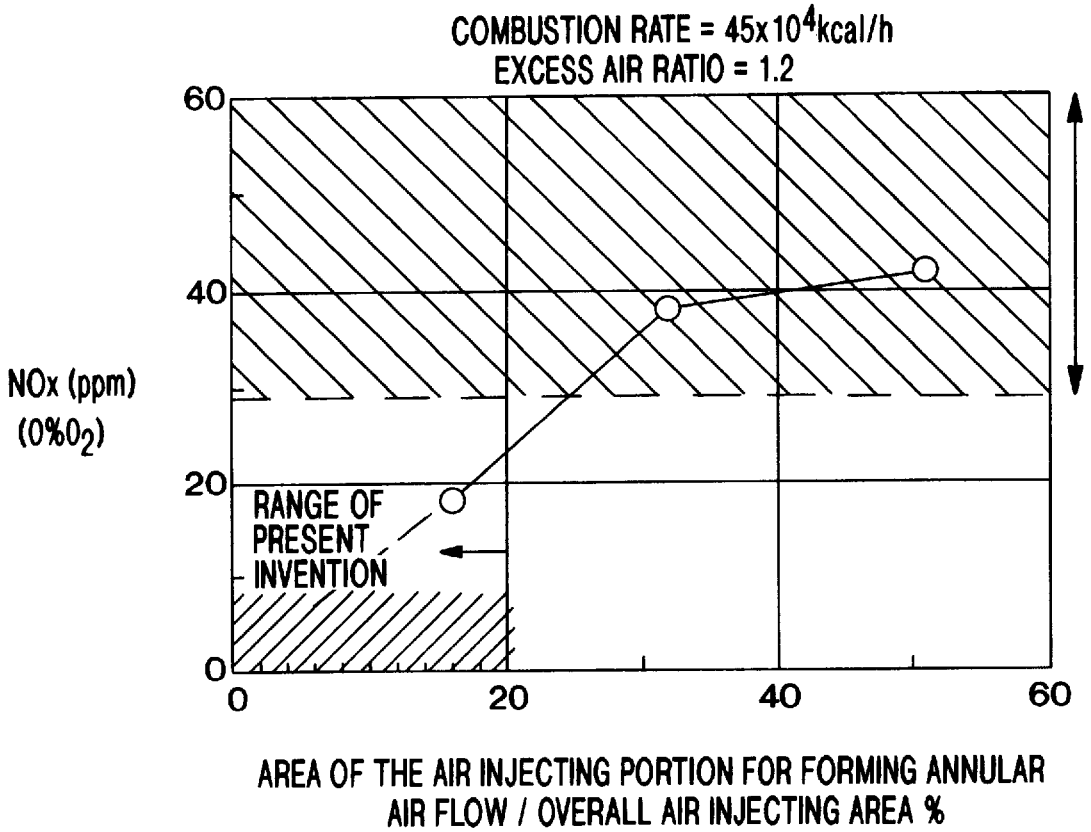
FIG. 25 is a diagram showing the NOx decrease performance affected by the rate of the area of the air injection portion for forming annular air flow to the overall air introducing area in Example C, in comparison with the performance of the conventional burners.

In the above configuration, the air injected from the air injecting portion 23 for forming annular air flow forms annular air flow 26 downstream of the shielding plate 4 as shown in FIGS. 23 and 24, and a strong negative pressure portion is formed inside the annular air flow 26, to increase the back flow and recirculation flow of furnace combustion gas, thereby further promoting the self-induced exhaust gas recirculation in the internal recirculation areas 14. The further promoted internal recirculation allows a powerful ignition source to be formed by the recirculation of the furnace combustion gas of high temperature to achieve excellent flame ignition and stable combustion, and to effectively promote the self-induced exhaust gas recirculation combustion, thereby promoting the NOx decrease effect. Irrespective of whether the air injection portion 23 for forming annular air flow is formed as the annular slit 24 or by arranging the small holes 25, the same action and effect can be brought about. If the area of the air injection portion 23 for forming annular air flow is 20% or less of the overall air introducing area, the phenomena and effect can be promoted (see FIG. 25).

Figure 26:
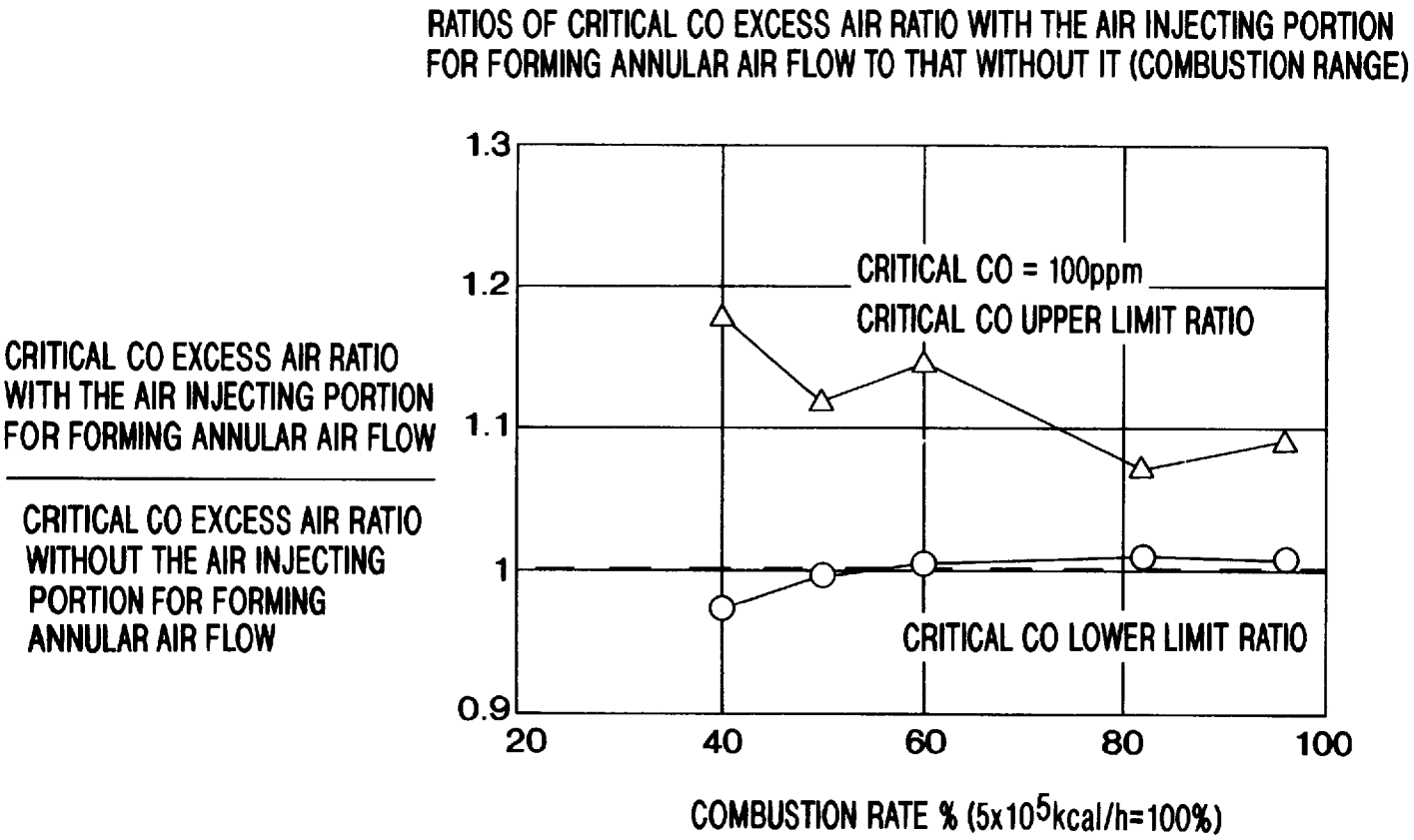
FIG. 26 is a performance comparison diagram showing measured upper limits and lower limits of the ratio of the critical CO excess air ratio in the case where the air injecting portion for forming annular air flow of Example C was provided, to critical CO excess air ratio in the case where it was not provided.

Furthermore, in the above combustion, the air injecting portion 23 for forming annular air flow greatly contributes to the expansion of the combustion range. FIG. 26 shows the upper and lower limits of the critical CO excess air ratio measured with and without the air injecting portion 23 for forming annular air flow. From FIG. 26 it can be clearly understood that the air injection portion 23 for forming annular air flow of Example C greatly increase the critical CO upper limit excess air ratio.

4. Embodiment Disclosed in Example D

One embodiment of the present invention is disclosed in Example D which greatly decreases NOx by injecting air flow from slot-like air injecting portions, and injecting a fuel into the air flow in the direction perpendicular to the air flow just before the air flow is injected from the slot-like air injection portions, while separating the fuel for injection. Also, as an auxiliary fuel so that diffusion flames may be formed with fuel wrapped by air and burned without being stabilized at the air injecting portions or fuel injecting portions to ensure that part of the combustion gas may be entrained by the auxiliary fuel flow, the air flow and the fuel flow before the diffusion flames are formed to effectively achieve the self-induced exhaust gas recirculation; forming the diffusion flames at various excess air ratios to achieve effective rich and lean flames, and furthermore, injecting air from an air injecting portion for forming annular air flow to form annular air flow downstream of a shielding plate so that a strong negative pressure portion may be formed inside the annual air flow to increase the back flow or recirculation flow of the furnace combustion gas for further promotion of internal recirculation, thereby forming a strong ignition source by the recirculation of high temperature furnace combustion gas, thus achieving excellent flame ignition and stable combustion, and effectively promoting said self-induced exhaust gas recirculation combustion.

To achieve this objective, the following means are necessary.

Figures 28A, 28B:
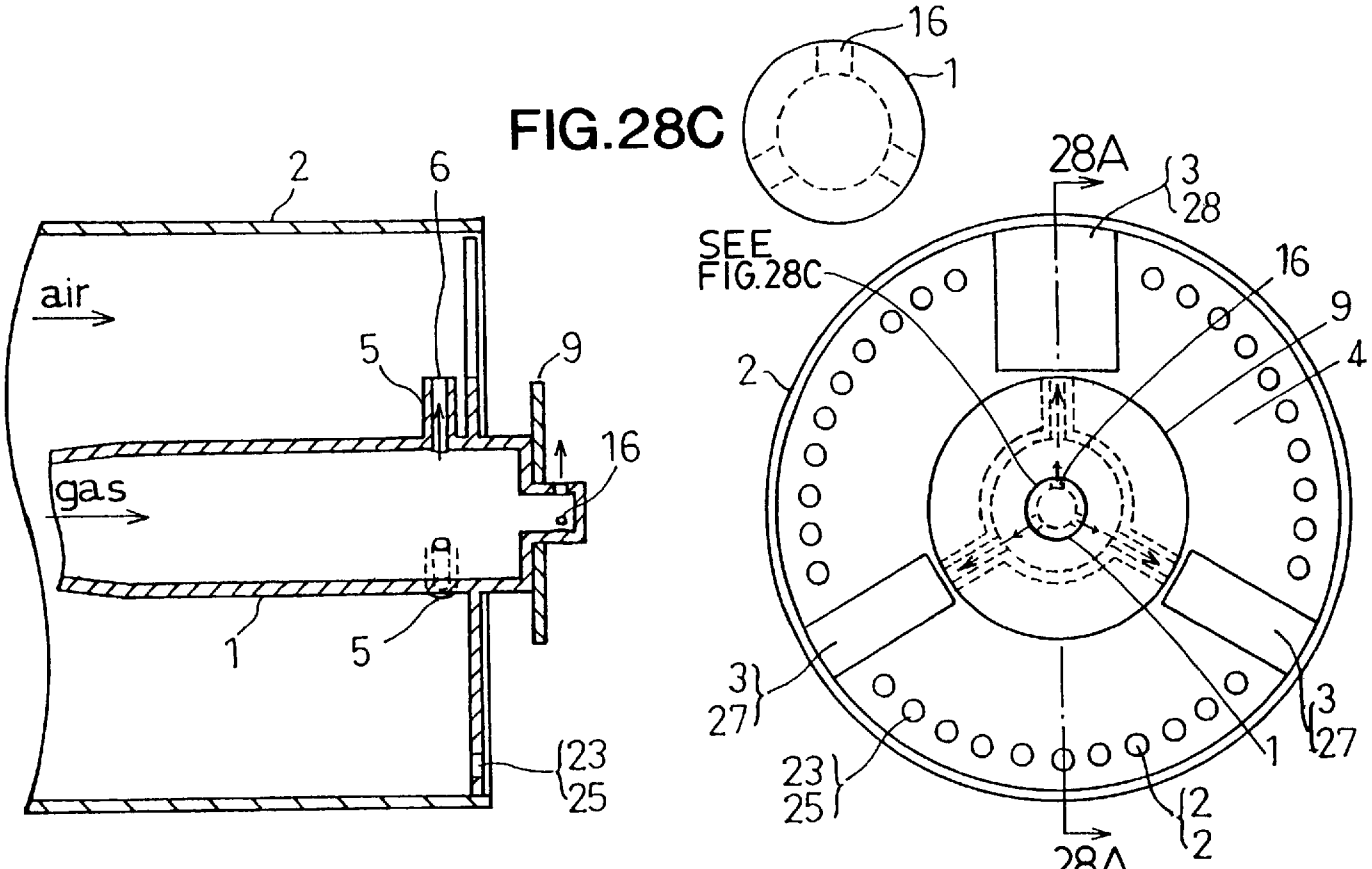
FIG. 28A is a partial cross-sectional view taken along line 28A of FIG. 28B of the embodiment of the present invention as disclosed in Example D.
FIG. 28B is a front view of the embodiment of the present invention as disclosed in Example D, having sectional arrows indicating the fuel flow of Example D shown in FIG. 28A.
Figures 34A, 34B, 34C, 34D, 34E, 34F, 34G:
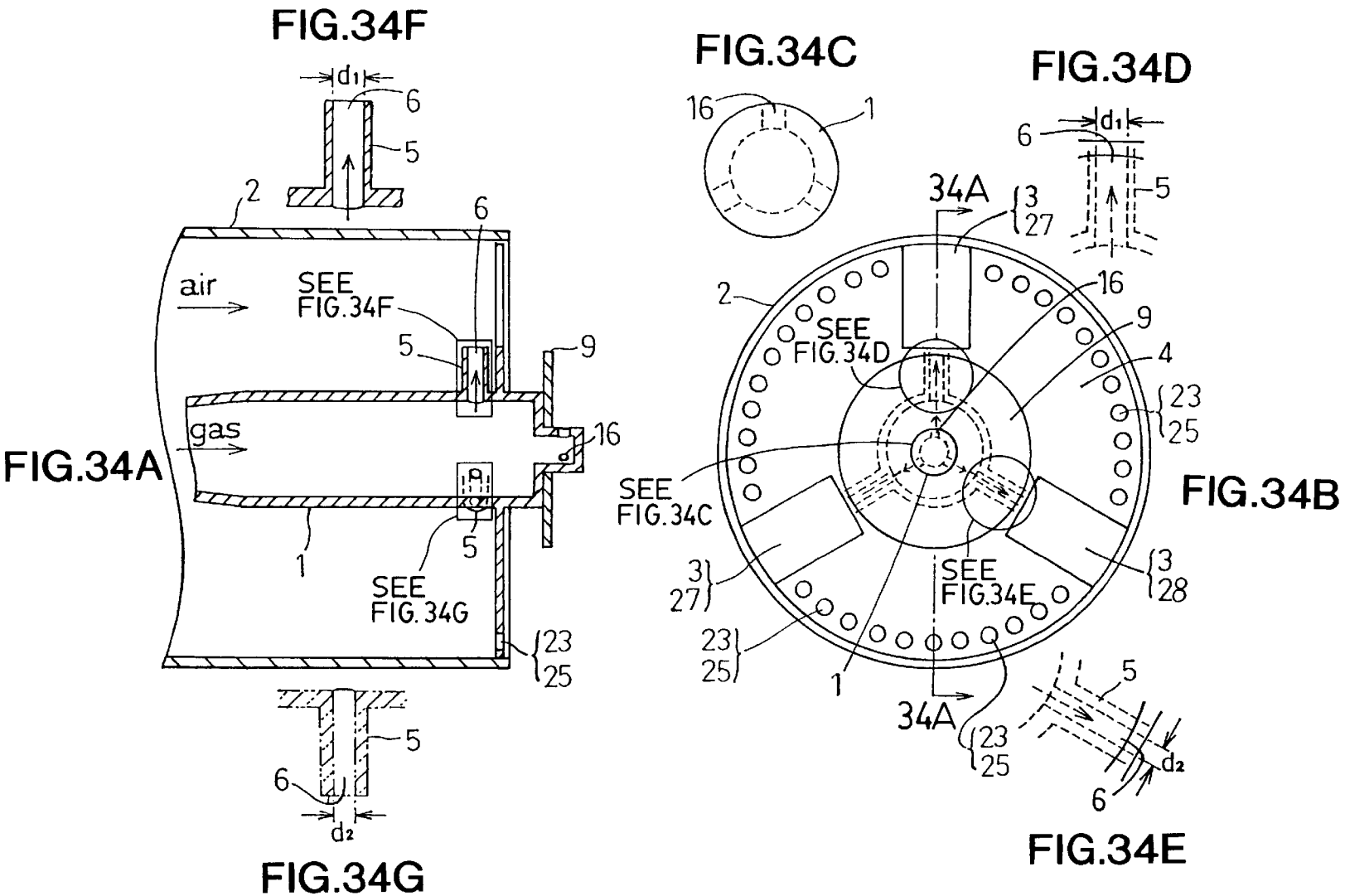
FIG. 34A is a partial cross-sectional view taken along line 34A of FIG. 34B of the embodiment of the present invention as disclosed in Example D.
FIG. 34B is a front view of the embodiment of the present invention as disclosed in Example D, having sectional arrows indicating the fuel flow of Example D shown in FIG. 34A.
FIG. 34C is an enlarged partial front view of the end of the fuel pipe with radial fuel injection holes.
FIG. 34D is an enlarged partial cross-sectional front view of the fuel passage in FIG. 34B.
FIG. 34E is an enlarged partial cross-sectional front view of the fuel passage in FIG. 34B.
FIG. 34F is an enlarged partial cross-sectional view of the fuel passage shown in FIG. 34A.
FIG. 34G is an enlarged partial cross-sectional front view of the fuel passage in FIG. 34G.

In FIGS. 27, 28, 33 and 34, symbol 1 denotes a fuel pipe installed in an air pipe 2, and a shield plate 4 provided with a plurality of slot-like air injecting portions 3 is installed around the fuel pipe 1 at the tip of the fuel pipe. Around or inside the edge of the shielding plate 4, an air flow injection portion 23 for forming annular air flow is provided, and at the base of the plurality of slot-like air injecting portions 3, base fuel injection pipes 5 connecting to the fuel pipe 1 are installed. The plurality of slot-like air injection portions 3 act as rich flame-forming air injecting portions 27, and a lean flame-forming air injecting portion 28. At the tips of the base fuel injection pipes 5, base fuel injecting portions 6 for injecting fuel in radial directions are provided. At the tip of the fuel pipe 1, radial fuel injection holes 16 for injecting the auxiliary fuel in the same directions as the injection directions of the base fuel injecting portions 6 are provided, and disc 9 larger in diameter than the fuel pipe 1 is provided upstream of the radial fuel injection holes 16. The air injection portion 23 for forming annular air flow can be formed as an annular slit 24 between the air pipe 2 and the shielding plate 4, or by arranging small holes 25 annularly inside the edge of the shielding plate 4. In FIGS. 28 and 34 the small holes 25 are only expressed for the sake of convenience.

In the case of FIGS. 29 and 35, radial fuel injection holes 16, for injecting the auxiliary fuel in radial direction into the spaces downstream of the areas between the respectively adjacent slot-like air injecting portions 3, are provided.

Figures 36A, 36B, 36C, 36D, 36E, 36F, 36G:
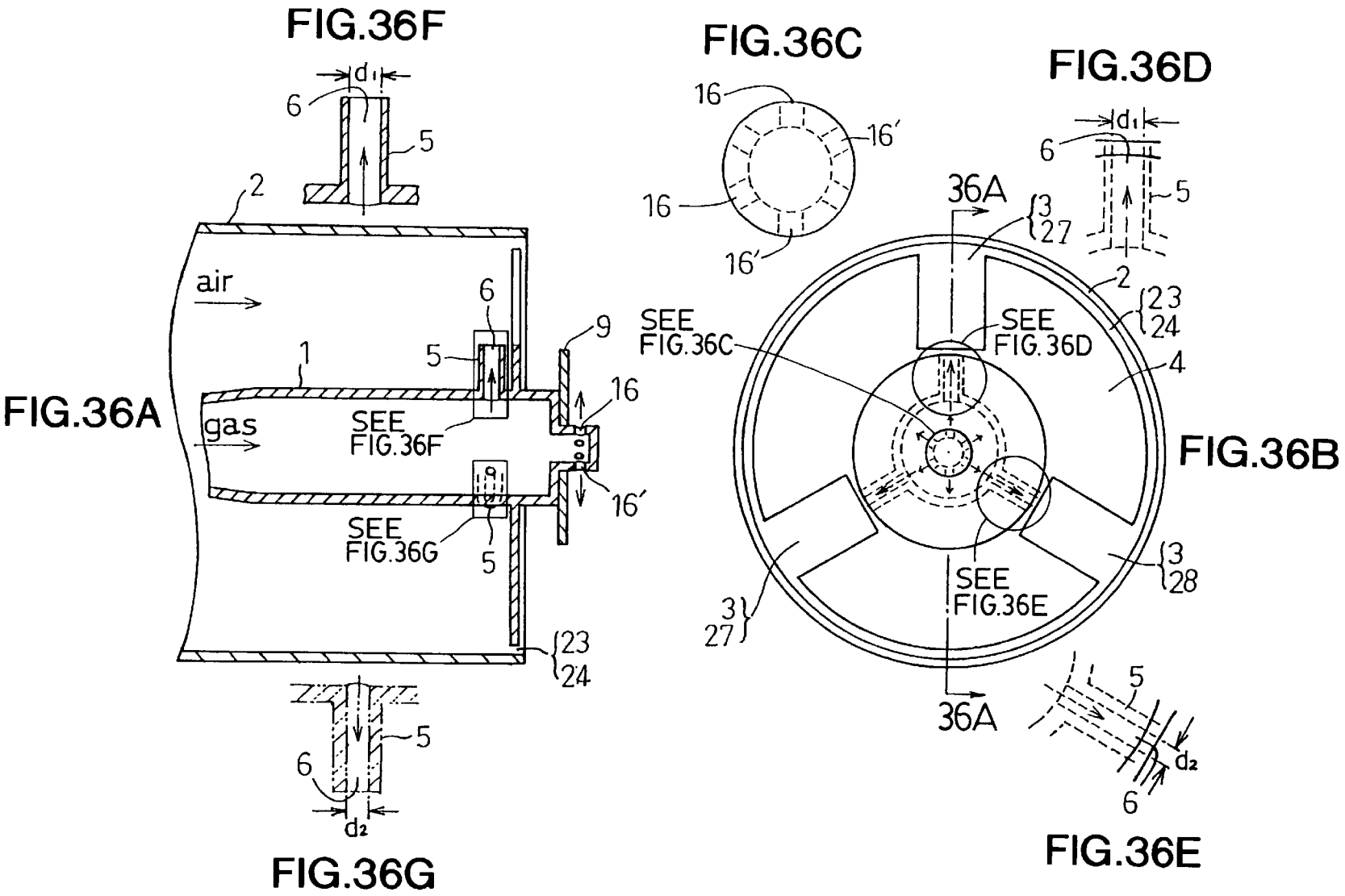
FIG. 36A is a partial cross-sectional view taken along line 36A of FIG. 36B of the embodiment of the present invention as disclosed in Example D.
FIG. 36B is a front view of the embodiment of the present invention as disclosed in Example D, having sectional arrows indicating the fuel flow of Example D shown in FIG. 36A.
FIG. 36C is an enlarged partial front view of the fuel pipe with radial fuel injection holes.
FIG. 36D is an enlarged partial cross-sectional view of the fuel passage shown in FIG. 36B.
FIG. 36E is an enlarged partial cross-sectional view of the fuel passage shown in FIG. 36B.
FIG. 36F is an enlarged partial cross-sectional view of the fuel passage shown in FIG. 36A.
FIG. 36G is an enlarged partial cross-sectional view of the fuel passage shown in FIG. 36A.

In the case of FIGS. 30 and 36, radial fuel injection holes 16' for injecting the auxiliary fuel in radial directions into the spaces downstream of the areas between the respectively adjacent slot-like air injecting portions 3, and the radial fuel injection holes 16 for injecting the auxiliary fuel in the same directions as the injection directions of the base fuel injecting portions 6, are provided.

Figures 31A, 31B, 31C, 31D:
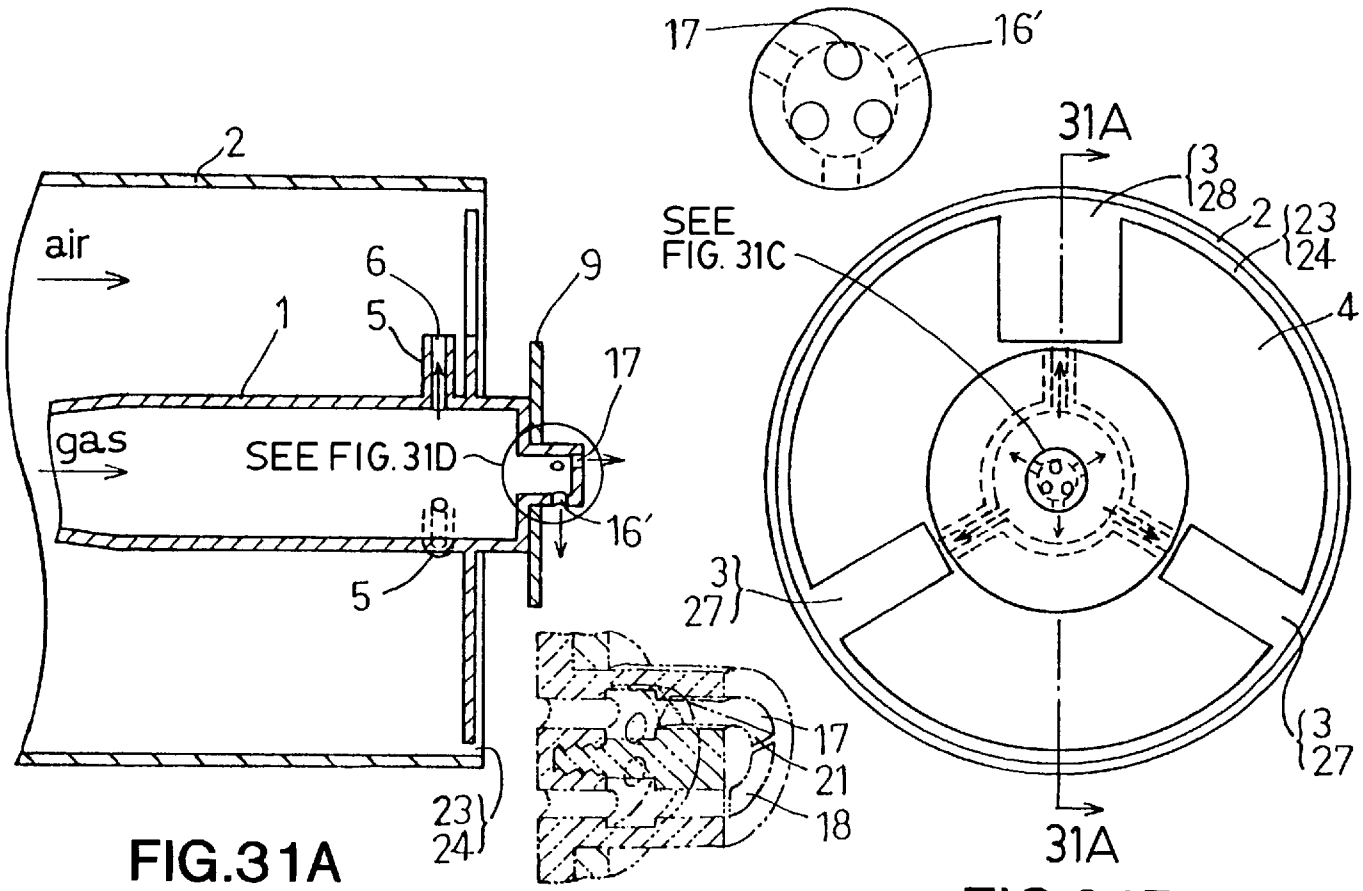
FIG. 31A is a partial cross-sectional view taken along line 31A of FIG. 31B of the embodiment of the present invention as disclosed in Example D.
FIG. 31B is a front view of the embodiment of the present invention as disclosed in Example D, having sectional arrows indicating the fuel flow of Example D shown in FIG. 31A.
FIG. 31C is an enlarged partial front view of the fuel pipe with radial fuel injection holes.
FIG. 31D is an enlarged partial cross-sectional view of the end of the fuel nozzle of one embodiment of the present invention as shown in FIG. 31A.
Figures 37A, 37B, 37C, 37D, 37E, 37F, 37G, 37H:
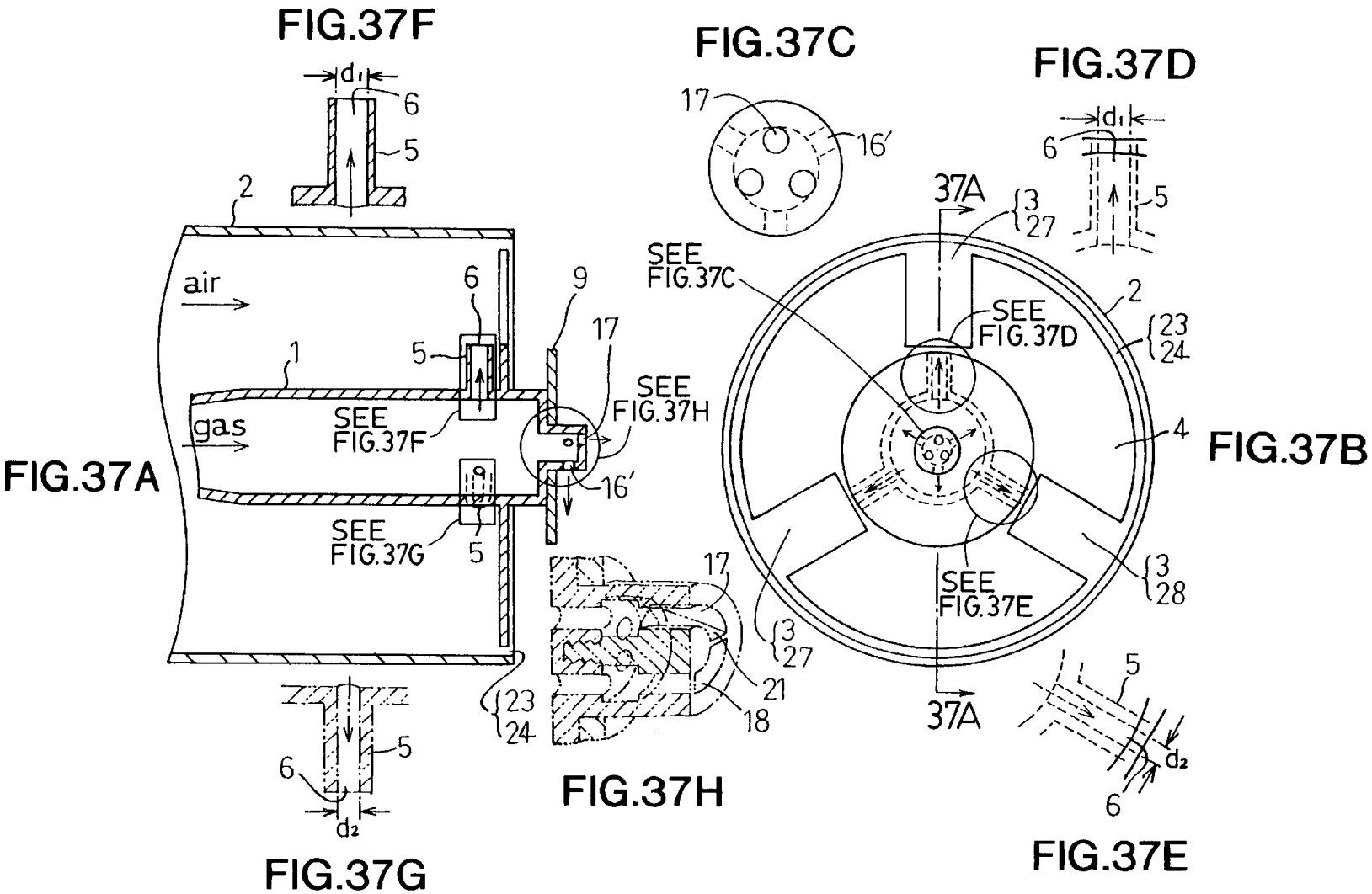
FIG. 37A is a partial cross-sectional view taken along line 37A of FIG. 37B of the embodiment of the present invention as disclosed in Example D.
FIG. 37B is a front view of the embodiment of the present invention as disclosed in Example D, having sectional arrows indicating the fuel flow of Example D shown in FIG. 37A.
FIG. 37C is an enlarged partial front view of the fuel pipe with radial fuel injection holes.
FIG. 37D is an enlarged partial cross-sectional view of the fuel passage shown in FIG. 37B.
FIG. 37E is an enlarged partial cross-sectional view of the fuel passage shown in FIG. 37B.
FIG. 37F is an enlarged partial cross-sectional view of the fuel passage shown in FIG. 37A.
FIG. 37G is an enlarged partial cross-sectional view of the fuel passage shown in FIG. 37A.
FIG. 37H is an enlarged cross-sectional view of the end of the fuel nozzle in one embodiment of the present invention as shown in FIG. 37A.

In the case of FIGS. 31 and 37, radial fuel injection holes 16' for injecting the auxiliary fuel in radial directions into the spaces downstream of the areas between the respectively adjacent slot-like air injecting portions 3, and a axial fuel injection holes 17 for injecting the auxiliary fuel in the central axial direction of the base fuel pipe 1, are provided.

Figures 32A, 32B, 32C, 32D:
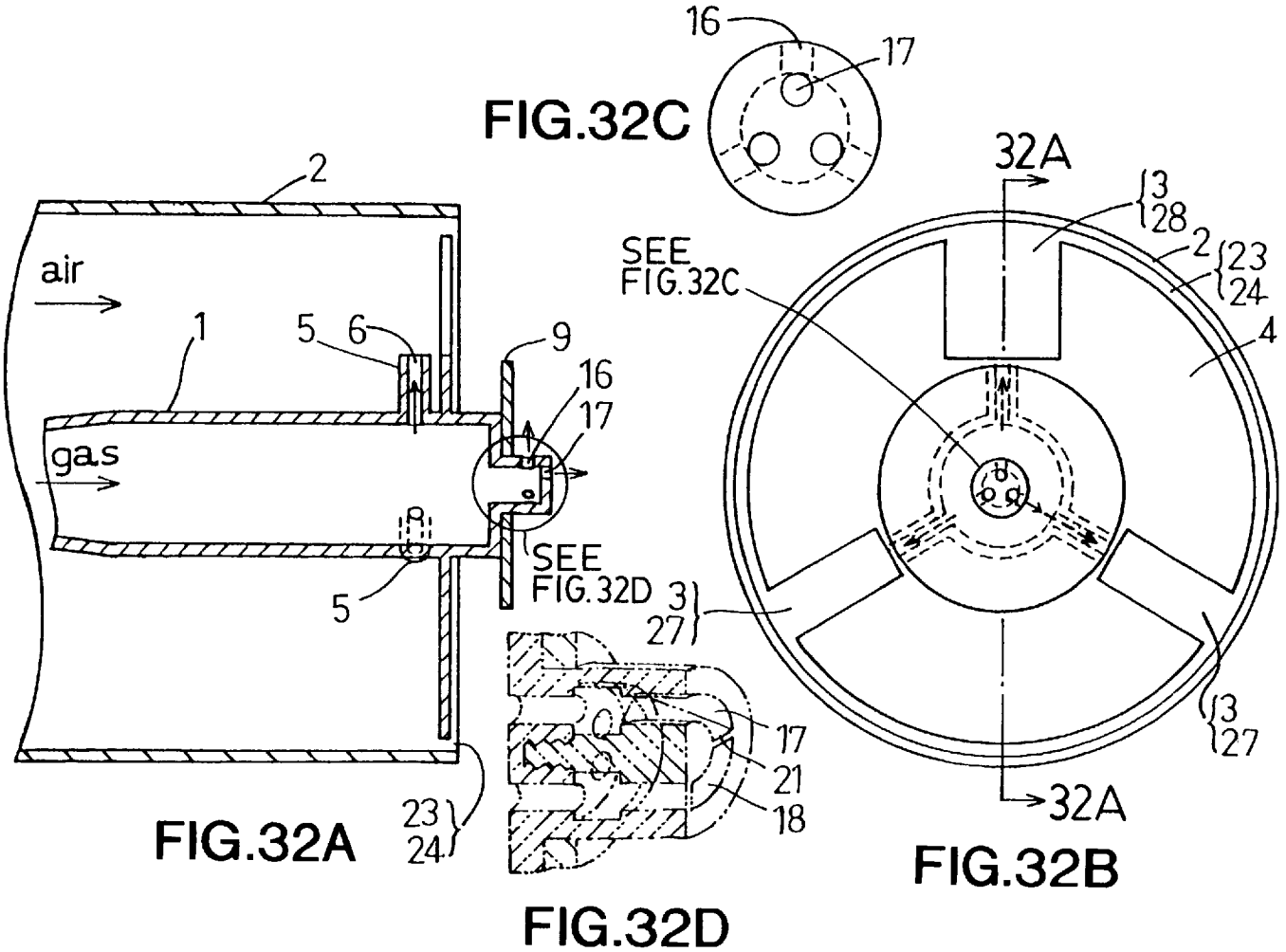
FIG. 32A is a partial cross-sectional view taken along line 32A of FIG. 32B of the embodiment of the present invention as disclosed in Example D.
FIG. 32B is a front view of the embodiment of the present invention as disclosed in Example D, having sectional arrows indicating the fuel flow of Example D as seen in FIG. 32A.
FIG. 32C is an enlarged partial front view of the fuel pipe with radial fuel injection holes.
FIG. 32D is an enlarged partial cross-sectional view of the end of the fuel nozzle of the embodiment of the present invention as shown in FIG. 32A.
Figures 33A, 33B, 33C, 33D, 33E, 33F, 33G:
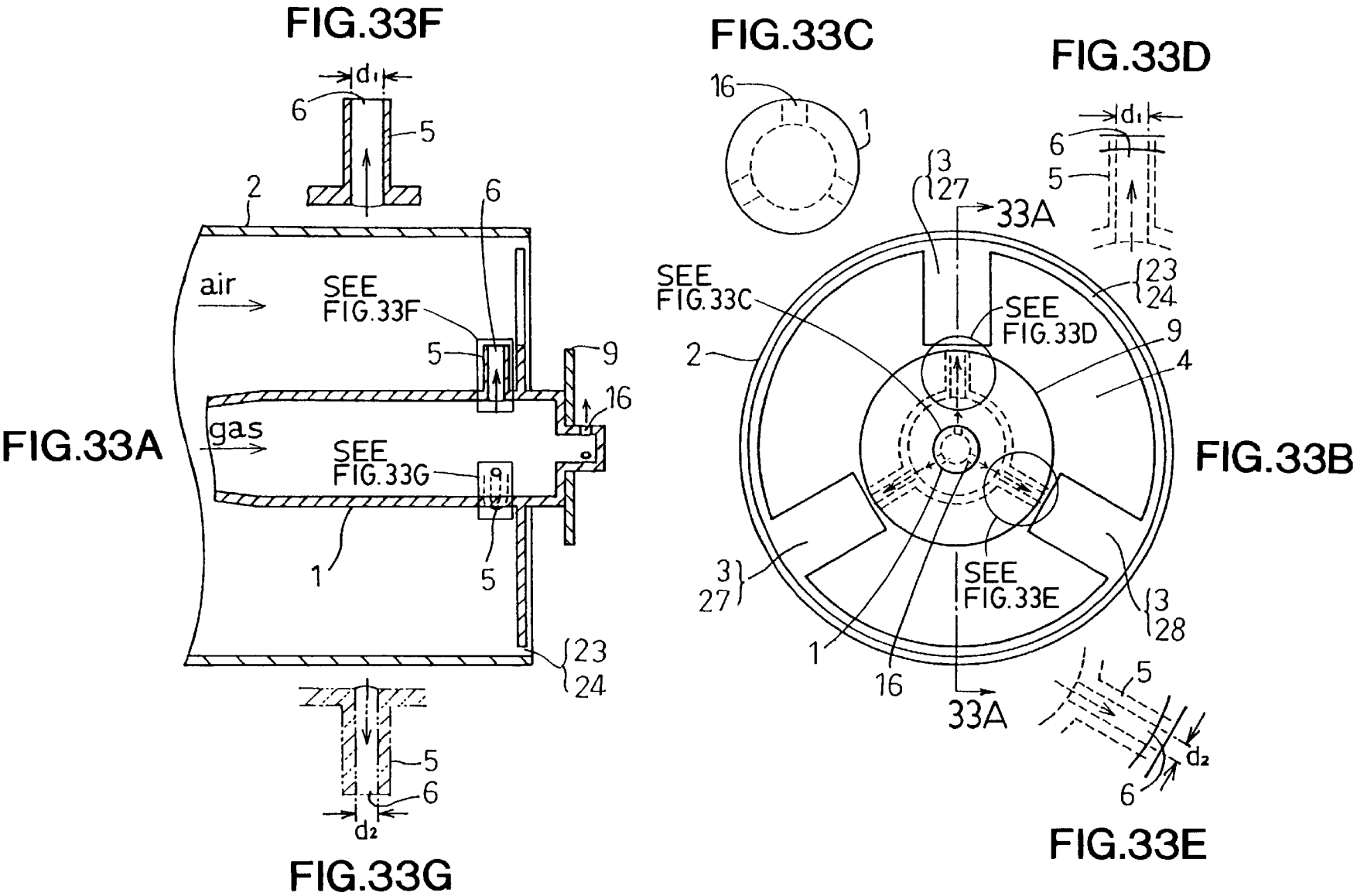
FIG. 33A is a partial cross-sectional view taken along line 33A of FIG. 33B of the embodiment of the present invention as disclosed in Example D.
FIG. 33B is a front view of the embodiment of the present invention as disclosed in Example D, having sectional arrows indicating fuel flow of Example D shown in FIG. 33A.
FIG. 33C is an enlarged partial front view of the fuel pipe with radial fuel injection holes.
FIG. 33D is an enlarged partial cross-sectional front view of the radial fuel passages shown in FIG. 33B.
FIG. 33E is an enlarged partial cross-sectional front view of the radial fuel passage shown in FIG. 33B.
FIG. 33F is an enlarged partial cross-sectional view of the fuel passage shown in FIG. 33A.
FIG. 33G is an enlarged partial cross-sectional front view of the fuel passage shown in FIG. 33A.
Figures 38A, 38B, 38C, 38D, 38E, 38F, 38G, 38H:
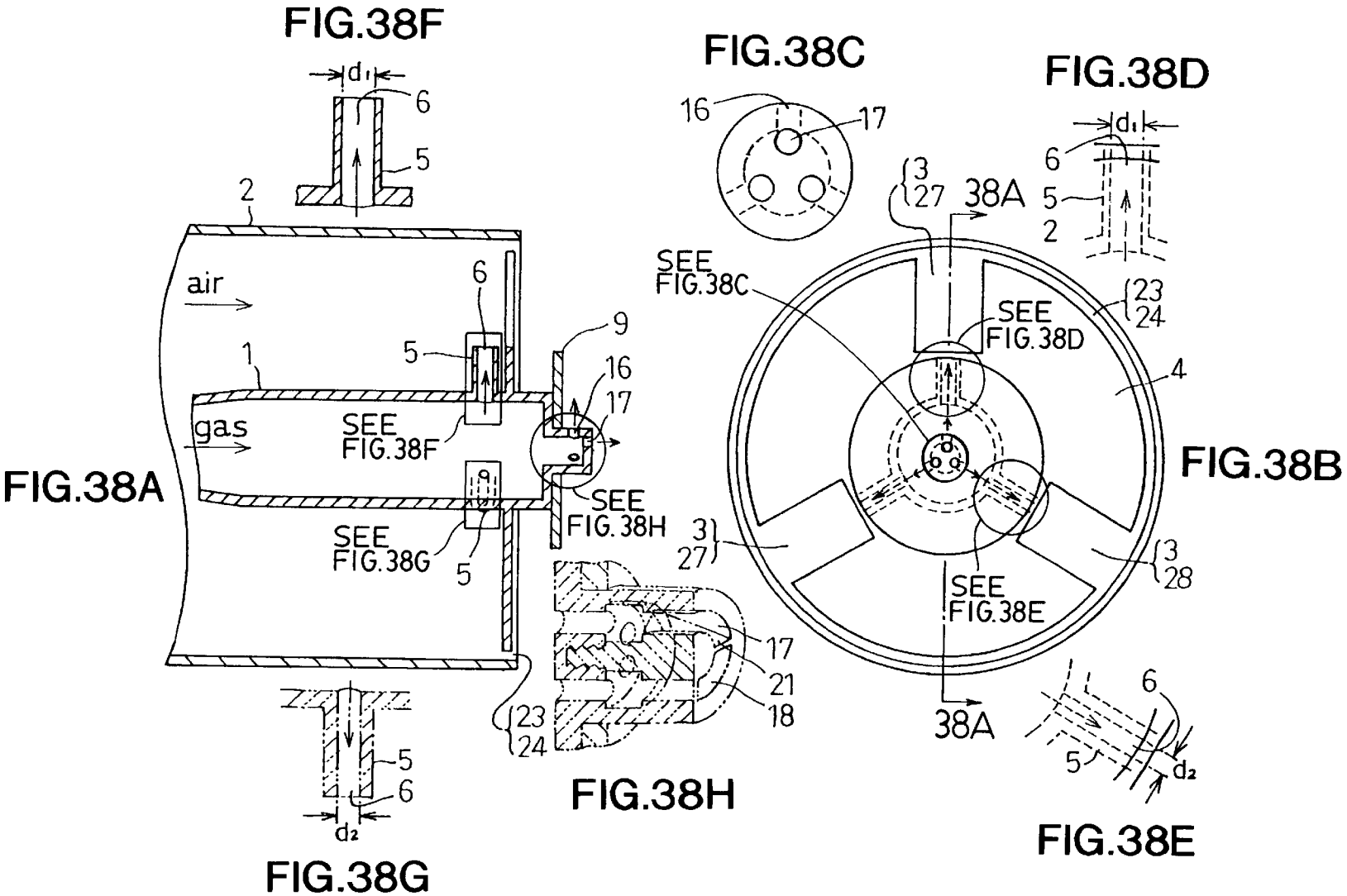
FIG. 38A is a partial cross-sectional view taken along line 38A of FIG. 38B of the embodiment of the present invention as disclosed in Example D.
FIG. 38B is a front view of the embodiment of the present invention disclosed in Example D, having sectional arrows indicating the fuel flow of Example D shown in FIG. 38A.
FIG. 38C is an enlarged partial front view of the fuel pipe with radial fuel injection holes.
FIG. 38D is an enlarged partial cross-sectional view of the fuel passage shown in FIG. 38B.
FIG. 38E is an enlarged partial cross-sectional view of the fuel passage shown in FIG. 38B.
FIG. 38F is an enlarged partial cross-sectional view of the fuel passage shown in FIG. 38A.
FIG. 38G is an enlarged partial cross-sectional view of the fuel passage shown in FIG. 38A; 38H is an enlarged cross-sectional view of the end of the fuel nozzle of one of the embodiments of the present invention shown in FIG. 38A.

In the case of FIGS. 32 and 38, radial fuel injection holes 16' for injecting the auxiliary fuel in the same directions as the injection directions of the base fuel injecting portions 6, and a central axial fuel injection holes 17 for injecting the auxiliary fuel in the central axial direction of the base fuel pipe 1, are provided.

The central axial fuel injection holes 17 can also be formed like annular hole 18 as illustrated. Symbol 21 denotes a swirl vane installed in the annular hole 18.

In the case of FIGS. 27 through 32, the rich flame-forming air injecting portions 27 and the lean flame-forming air injection portion 28 as the plurality of slot-like air injecting portions 3 are relatively different in area. In the drawings, for example, one lean flame-forming air injecting portion 28, and two rich flame-forming air injection portions 27 smaller than it in area are provided. Since the respective base fuel injecting pipes 5 are equal in diameter in this case, a lean flame with excessive air is formed downstream of the lean flame-forming air injecting portion 28 large in the area of the slot-like air injecting portion 3, and rich flames with excessive fuel are formed downstream of the two rich flame-forming air injecting portions 28 smaller in area.

In the case of FIGS. 33 through 38, the plurality of slot-like air injecting portions 3 are equal in area, and the base fuel injection portions 6 are different in area to form two rich flame-forming fuel injecting portions and a lean flame-forming fuel injection portion. For example, since the lean flame-forming injecting portion 28 of d2 in diameter is smaller than the other base fuel injecting portions 6 as the rich flame-forming fuel injecting portions 27 of d1 in diameter, a lean flame with excessive air is formed downstream of the lean flame-forming fuel injecting portion 28, and rich flames with excessive fuel are formed downstream of the other rich flame-forming fuel injecting portions 27.

It is also possible that the plurality of slot-like air injecting portions 3 are relatively different in area and that the plurality of base fuel injecting portions 6 are relatively different in area for forming the rich flame-forming injecting portions 27 and the lean flame-forming injecting portions 28 by both the fuel and air injecting portions to achieve rich and lean combustion downstream of the rich flame-forming injecting portions 27 and the lean flame-forming injecting portions 28. This is, both the amount of the air injected and the amount of fuel injected can be relatively changed to properly set both the air ratios properly for effectively achieving rich and lean combustion.

In the above combustion, in this example, since the plurality of slot-like air injection portions 3 are formed as the rich flame-forming air injection portions 27 and the lean flame-forming air injecting portion 28, rich combustion and lean combustion progress concurrently. That is, downstream of the rich flame-forming air injecting portions 27, rich flames with excessive fuel are formed, and downstream of the lean flame-forming air injection portion 27, a lean flame with excessive air is formed. The former rich flames are lower in NOx emission than the stoichiometric combustion flame due to an insufficient oxygen concentration and the resultant drop of flame temperature, and the latter lean flame is also lower in NOx emission due to the drop of flame temperature. In this case, if both the excess air ratios are properly set so that the excessive air of the lean flame may be used to allow sufficient combustion of the excessive fuel in the right flames, effective rich and lean combustion can be achieved. In this case, since the NOx emission level is the weighted mean of the fuel flow rates of both rich flames and the lean flame lower in NOx emission level than that of a flame near the stoichiometric excess air ratio as described above, a low NOx emission level can also be achieved in the entire combustion. Furthermore, in the present invention with an essential feature that the flames are not stabilized at any injection portion, since the fuel and combustion air entrain the combustion gas sufficiently before initiation of combustion, a lower NOx level can be more effectively achieved due to a lower oxygen concentration and a lower flame temperature. This rich and lean combustion can further promote the decrease of NOx in synergism with the peculiar combustion described above.

Figure 39:
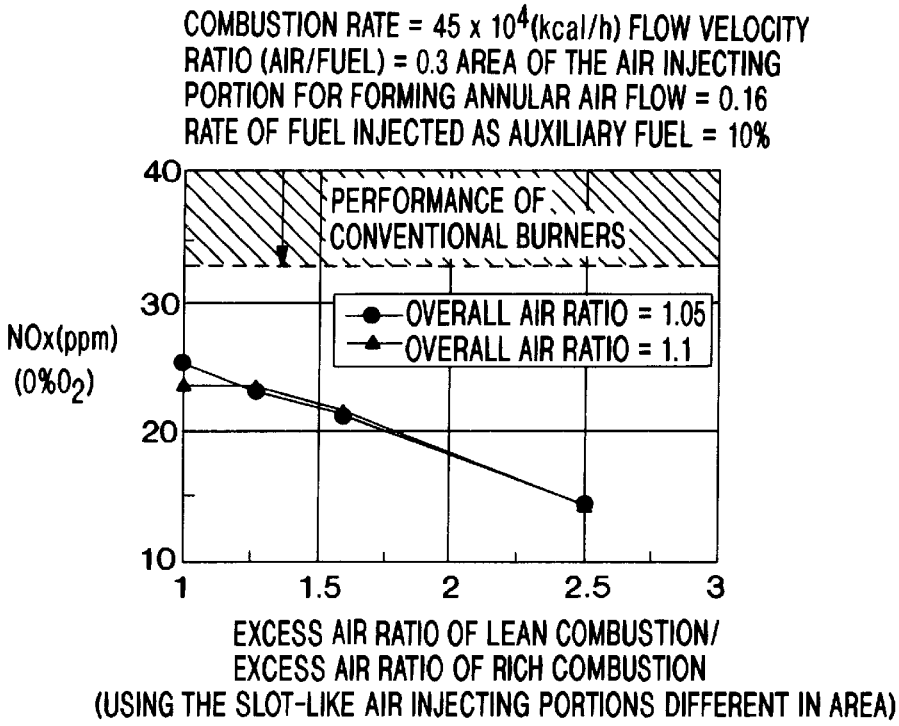
FIG. 39 is a diagram showing NOx decrease performance for comparing Example D with the conventional methods.

FIG. 39 shows the NOx decrease effect achieved by using the plurality of slot-like air injecting portions 3 different in size as rich flame-forming air injecting portions 27 and the lean flame-forming air injecting portion 28. It can be understood that an air/fuel flow velocity ratio of 0.2 or more, the use of 10 to 20% of the overall fuel as the auxiliary fuel, the use of the air injecting portion 23 for forming annular air flow with an area of 20% or less of the overall air injecting area, and the adoption of the above mentioned rich and lean combustion allowed the NOx to be decrease remarkably compared to the conventional examples.

Figure 40:
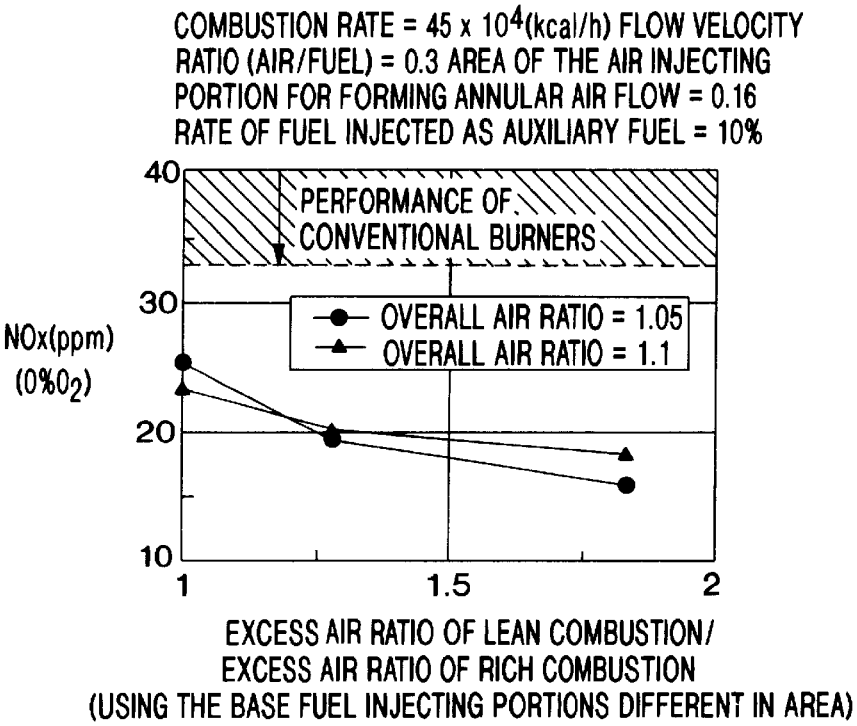
FIG. 40 is a diagram showing NOx decrease performance for comparing Example D with the conventional methods.

FIG. 40 shows the NOx decrease effect achieved by using the base fuel injecting portions 6 different in area as the rich flame-forming fuel injecting portions 27 and the lean flame-forming fuel infecting portion 28, using the plurality of slot-like air injecting portions 3 equal in size. It can be understood that an air/fuel flow velocity ratio of 0.2 or more, the use of 10 to 20% of the overall fuel as the auxiliary fuel, the use of the air injecting portion 23 for forming annular air flow with an area of 20% or less of the overall air injecting area, and the adoption of the above mentioned rich and lean combustion allowed the NOx to decrease remarkably compared to the conventional examples.

In the above combustion, if the combustion air introduced into the air pipe 2 is the oxygen enriched air containing more than 21 vol. % of oxygen, the combustion quantity can be increased, while the low NOx combustion is sustained.

What is claimed is:

1. A low nitrogen oxide generating combustion method, comprising the steps of:

installing a shielding plate with a plurality of slot-like air injecting portions, around a fuel pipe at the tip of the fuel pipe in the inside surface of an air pipe;

installing base fuel injecting pipes connecting to said fuel pipe at the base of said plurality of slot-like air injecting portions;

installing base fuel injecting portions for injecting the fuel into the air pipe in radial directions at the tips of the base fuel injecting pipes;

wherein the fuel injected from said base fuel injecting portions is injected in the direction perpendicular to the air flow just before the air flow is injected from said plurality of slot-like air injecting portions, and the ratio of the air flow at said slot-like air injecting portions to the fuel flow velocity at the base fuel injecting portions is about 0.2 or more.

2. A low nitrogen oxide generating combustion apparatus comprising a shielding plate with a plurality of slot-like air injecting portions, being installed around a fuel pipe at the tip of the fuel pipe in contact with the inside surface of an air pipe; base fuel injecting pipes connecting to said fuel pipe, being installed at the bases of said plurality of slot-like air injecting portions; and base fuel injecting portions for injecting the fuel into the air pipe in radial directions being installed at the tips of the base fuel injecting pipes.

3. A low nitrogen oxide generating combustion method according to claim 1, wherein the tip of the fuel pipe is protruded from the shielding plate, and a disc larger in diameter than the fuel pipe is installed at the tip of the fuel pipe for forming an exhaust gas recirculation promoting area downstream of the disc.

4. A low nitrogen oxide generating combustion apparatus according to claim 2, wherein the tips of the fuel pipe is protruded from the shielding plate, and a disc larger in diameter than the fuel pipe is installed at the tip of the fuel pipe for forming an exhaust gas recirculation promoting area downstream of the disc.

5. A low nitrogen oxide generating combustion method according to claim 1, wherein the tip of the fuel pipe is protruded beyond the shielding plate, and auxiliary fuel injecting holes for injecting an auxiliary fuel are formed at the tip for injecting 10 to 20% of the overall fuel as the auxiliary fuel from the auxiliary fuel injection holes to entrain the furnace combustion gas by the injection energy.

6. A low nitrogen oxide generating combustion method according to claim 3, wherein the tip of the fuel pipe is protruded beyond the disc, and auxiliary fuel injection holes for injecting an auxiliary fuel are formed at the tip for injecting 10 to 20% of the overall fuel as the auxiliary fuel from the auxiliary fuel injection holes to entrain the furnace combustion gas by the injection energy.

7. A low nitrogen oxide generating combustion apparatus according to claim 2, wherein the tip of the fuel pipe is protruded beyond the shielding plate, and auxiliary fuel injection holes for injecting an auxiliary fuel are formed at the tip.

8. A low nitrogen oxide generating combustion apparatus according to claim 4, wherein the tip of the fuel pipe is protruded beyond the disc, and auxiliary fuel injection holes for injecting an auxiliary fuel are formed at the tip.

9. A low nitrogen oxide generating combustion method according to claim 5, wherein radial fuel injection holes for injecting the auxiliary fuel in the same directions as the injection directions of the base fuel injecting portions and/or in radial directions into the spaces downstream of the areas between the respectively adjacent slot-like air injecting portions are provided for injecting the auxiliary fuel in radial directions into the spaces downstream of the shielding plate.

10. A low nitrogen oxide generating combustion apparatus according to claim 7, wherein radial fuel injection holes for injecting the auxiliary fuel in the same directions as the injection directions of the base fuel injecting portions and/or in radial directions into the spaces downstream of the areas between the respectively adjacent slot-like air injecting portions are provided.

11. A low nitrogen oxide generating combustion method according to claim 5, wherein a central axial fuel injection hole for injecting the auxiliary fuel in the central axial direction of the fuel pipe is provided for injecting the auxiliary fuel in the central axial direction of the fuel pipe.

12. A low nitrogen oxide generating combustion apparatus according to claim 7, wherein central axial fuel injection holes for injecting the auxiliary fuel in the central axial direction of the fuel pipe is provided.

13. A low nitrogen oxide generating combustion method according to claim 11, wherein the central axial fuel injection hole is formed as an annular hole for injecting the auxiliary fuel annularly from the central axial fuel injection hole to entrain the furnace combustion gas.

14. A low nitrogen oxide generating combustion apparatus according to claim 12, wherein the central axial fuel injection holes are formed as an annular hole.

15. A low nitrogen oxide generating combustion method according to claim 13, wherein a swirl vane is installed in the annular hole for injecting the auxiliary fuel from the annular hole annularly in swirl to entrain the combustion gas in the furnace.

16. A low nitrogen oxide generating combustion apparatus according to claim 14, wherein a swirl vane is installed in the annular hole.

17. A low nitrogen oxide generating combustion method according to claim 1, wherein an air injecting portion for forming annular air flow is formed around or inside the edge of the shielding plate for injecting air from the air injecting portion for forming annular air flow.

18. A low nitrogen oxide generating combustion apparatus according to claim 2, wherein an air injecting portion for forming annular air flow is formed around or inside the edge of the shielding plate.

19. A low nitrogen oxide generating combustion method according to claim 17, wherein the air injecting portion for forming annular air flow is formed by an annular slit formed between the air pipe and the shielding plate, and air is injected from the annular slit.

20. A low nitrogen oxide generating combustion apparatus according to claim 18, wherein the air injecting portion for forming annular air flow is formed by an annular slit formed between the air pipe and the shielding plate.

21. A low nitrogen oxide generating combustion method according to claim 17, wherein the air injecting portion for forming annular air flow is formed by small holes annularly arranged inside the edge of the shielding plate, and air is injected from the small holes.

22. A low nitrogen oxide generating combustion apparatus according to claim 18, wherein the air injecting portion for forming annular air flow is formed by small holes annularly arranged inside the edge of the shielding plate.

23. A low nitrogen oxide generating combustion method according to claim 17, wherein the area of the air injecting portion for forming annular air flow is 20% or less of the overall air injecting area.

24. A low nitrogen oxide generating combustion method according to claim 19, wherein the area of the air injecting portion for forming annular air flow is 20% or less of the overall air injecting area.

25. A low nitrogen oxide generating combustion method according to claim 21, wherein the area of the air injecting portion for forming annular air flow is 20% or less of the overall air injecting area.

26. A low nitrogen oxide generating combustion apparatus according to claim 18, wherein the area of the air injecting portion for forming annular air flow is 20% or less of the overall air injecting area.

27. A low nitrogen oxide generating combustion apparatus according to claim 20, wherein the area of the air injecting portion for forming annular air flow is 20% or less of the overall air injecting area.

28. A low nitrogen oxide generating combustion apparatus according to claim 22, wherein the area of the air injecting portion for forming annular air flow is 20% or less of the overall air injecting area.

29. A low nitrogen oxide generating combustion method according to claim 1, wherein the slot-like air injecting portions are provided as rich flame-forming air injecting portions and lean flame-forming air injection portions to burn with excessive fuel at the rich flame-forming air injecting portions and with excessive air at the lean flame-forming air injecting portions for achieving rich and lean combustion.

30. A low nitrogen oxide generating combustion apparatus according to claim 2, wherein the slot-like air injecting portions are provided as rich flame-forming air injecting portions and lean flame-forming air injecting portions.

31. A low nitrogen oxide generating combustion method according to claim 29, wherein the rich flame-forming air injecting portions and the lean flame-forming air injection portions are formed as the plurality of slot-like air injecting portions relatively different in area to achieve rich and lean combustion downstream of the rich flame-forming air injecting portions and the lean flame-forming air injecting portions.

32. A low nitrogen oxide generating combustion apparatus according to claim 30, wherein the rich flame-forming air injecting portions and the lean flame-forming air injection portions are formed as the plurality of slot-like air injecting portions relatively different in area.

33. A low nitrogen oxide generating combustion method according to claim 29, wherein the plurality of base fuel injection portions are formed to be relatively different in area to act as rich flame-forming fuel injecting portions and the lean flame-forming fuel injecting portions, instead of using the rich flame-forming air injecting portions and the lean flame-forming air injection portions for achieving rich and lean combustion in the respective areas downstream of the rich flame-forming fuel injecting portions and the lean flame-forming fuel injecting portions.

34. A low nitrogen oxide generating combustion apparatus according to claim 30, wherein the plurality of base fuel injection portions are formed to be relatively different in area to act as rich flame-forming fuel injecting portions and the lean flame-forming fuel injecting portions, instead of using the rich flame-forming air injecting portions and the lean flame-forming air injection portions.

35. A low nitrogen oxide generating combustion method according to claim 29, wherein the plurality of slot-like air injecting portions and the plurality of base fuel injecting portions are formed to be relatively different in area to act a rich flame-forming injecting portions and rich flame-forming injecting portions for achieving rich and lean combustion in the respective areas downstream of the rich flame-forming injecting portions and the lean flame-forming injection portions.

36. A low nitrogen oxide generating apparatus according to claim 30, wherein the plurality of slot-like air injecting portions and the plurality of base fuel injecting portions are formed to be relatively different in area to act as rich flame-forming injection portions and lean flame-forming injecting portions.

37. A low nitrogen oxide generating combustion method according to claim 1, wherein oxygen enriched air of about 21 vol. % or more in oxygen concentration is used as the combustion air to be introduced into the air pipe.

* * * * *